US010220626B2

(12) United States Patent
Toya et al.

(10) Patent No.: US 10,220,626 B2
(45) Date of Patent: Mar. 5, 2019

(54) LIQUID CONTAINER

(71) Applicant: SEIKO EPSON CORPORATION, Tokyo (JP)

(72) Inventors: Akihiro Toya, Nagano (JP); Hiroyuki Kawate, Yamanashi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/672,378

(22) Filed: Aug. 9, 2017

(65) Prior Publication Data

US 2018/0043696 A1 Feb. 15, 2018

(30) Foreign Application Priority Data

Aug. 12, 2016 (JP) ..... 2016-158398

(51) Int. Cl.
*B41J 2/175* (2006.01)
*B41J 29/13* (2006.01)

(52) U.S. Cl.
CPC ..... *B41J 2/17513* (2013.01); *B41J 2/175* (2013.01); *B41J 2/1752* (2013.01); *B41J 2/17509* (2013.01); *B41J 2/17523* (2013.01); *B41J 2/17553* (2013.01); *B41J 2/17556* (2013.01); *B41J 29/13* (2013.01); *B41J 2002/17516* (2013.01)

(58) Field of Classification Search
None
See application file for complete search history.

(56) References Cited

U.S. PATENT DOCUMENTS 7,455,396 B2 11/2008 Wakayama
8,136,932 B2 3/2012 Nozawa et al.
9,358,796 B2 6/2016 Tsukahara et al.
(Continued)

FOREIGN PATENT DOCUMENTS

EP 0927637 A1 7/1999
EP 1541358 A2 6/2005
(Continued)

OTHER PUBLICATIONS

The Extended European Search Report for the corresponding European Patent Application No. 17185714.7 dated May 3, 2018.
(Continued)

*Primary Examiner* — Matthew Luu
*Assistant Examiner* — Tracey McMillion

(57) ABSTRACT

A technique is provided with which the concentration in liquid to be supplied to a liquid ejection apparatus is less likely to be uneven. A liquid container for supplying a liquid having a precipitating component to a liquid ejection apparatus includes: a liquid container, a liquid leading portion for leading the liquid in the liquid containing portion to the liquid ejection apparatus; a liquid flow tube that has a base end connected to the liquid leading portion, the liquid flow tube extending within the liquid containing portion from the liquid leading portion toward the second end; and a spacer member that is provided in the liquid containing portion and has a spacer body forming a liquid-retaining space for retaining the liquid in the liquid containing portion. The spacer member is coupled to the liquid leading portion. The liquid flow tube is coupled to the spacer member.

11 Claims, 23 Drawing Sheets

(56) References Cited

U.S. PATENT DOCUMENTS

| | | | |
|---|---|---|---|
| 2009/0015642 | A1 | 1/2009 | Nozawa et al. |
| 2016/0001565 | A1 | 1/2016 | Hsia et al. |

FOREIGN PATENT DOCUMENTS

| | | | | |
|---|---|---|---|---|
| EP | 2796294 | A1 | | 10/2014 |
| EP | 3184310 | A1 | | 6/2017 |
| JP | 2008-087486 | A | | 4/2008 |
| JP | 2009-034989 | A | | 2/2009 |
| JP | 4410023 | B2 | | 2/2010 |
| JP | 4519070 | B2 | | 8/2010 |
| JP | 2011-207120 | A | | 10/2011 |
| JP | 2011-235506 | A | | 11/2011 |
| JP | 2015-168247 | A | | 9/2015 |
| JP | 2015-168248 | A | | 9/2015 |
| JP | 2015168247 | A | * | 9/2015 |

OTHER PUBLICATIONS

The Extended European Search Report for the corresponding European Patent Application No. 17185714.7 dated Dec. 15, 2017.

* cited by examiner

LIQUID CONTAINER

CROSS REFERENCE TO RELATED APPLICATIONS

This application claims priority to Japanese Application No. 2016-158398 filed on Aug. 12, 2016. The entire disclosure of this Japanese application is expressly incorporated by reference herein. The present invention relates to a technique for liquid containers.

BACKGROUND

1. Technical Field

The present invention relates to a technique for liquid containers.

2. Related Art

Hitherto, liquid containers for supplying a liquid having a precipitating component to a liquid ejection apparatus are known (e.g. JP-A-2009-34989, Japanese Patent No. 4,519,070, JP-A-2015-168247, and JP-A-2008-87486). A liquid container includes a liquid containing portion for containing the liquid, and a liquid leading portion for leading the liquid to the liquid ejection apparatus.

When a liquid containing a precipitating component is supplied to the liquid ejection apparatus, there may be an area where the concentration of the precipitating component is higher and an area where this concentration is lower due to precipitation of the precipitating component within the liquid containing portion. In this case, the concentration in the liquid supplied from the liquid container to the liquid ejection apparatus is uneven. For this reason, for example, the print quality is degraded, or a head for ejecting the liquid becomes clogged, which is inconvenient.

In some known liquid containers, a spacer member or a liquid-retaining portion for retaining, in the liquid containing portion, high-concentration liquid that contains a large amount of a precipitating component is arranged in the liquid containing portion, in order to make the concentration in the liquid supplied to the liquid ejection apparatus less uneven (e.g. JP-A-2009-34989, Japanese Patent No. 4,519,070, and JP-A-2015-168247). Regarding some known liquid containers, low-concentration liquid that is present in an upper portion of the liquid containing portion and high-concentration liquid that is present in a lower portion of the liquid containing portion are mixed in the liquid leading portion, and are thereafter supplied to the liquid ejection apparatus (e.g. JP-A-2015-168247 and JP-A-2008-87486).

However, it is difficult to reduce the difference in the concentration between the liquid in the upper portion of the liquid containing portion and the liquid in the lower portion thereof only by providing a member for retaining high-concentration liquid in the liquid containing portion. Accordingly, the concentration in the liquid supplied to the liquid ejection apparatus may be uneven. When the liquid in the upper portion of the liquid containing portion and the liquid in the lower portion thereof are mixed and then supplied to the liquid ejection apparatus, the following problems may occur. For example, there may be cases where it is difficult to cause both the low-concentration liquid that is present in an upper portion of the liquid containing portion and the high-concentration liquid that is present in a lower portion of the liquid containing portion to stably flow into the liquid leading portion, or it is difficult to cause both liquids to efficiently flow into the liquid leading portion. As a result, the concentration in the liquid in the liquid containing portion supplied to the liquid ejection apparatus may be uneven. In particular, these problems may be noticeable when the liquid in the liquid containing portion has been consumed and the amount of liquid therein has decreased.

For this reason, regarding the known techniques, there is a need for a technique with which the concentration in the liquid supplied to the liquid ejection apparatus is less likely to be uneven.

SUMMARY

The invention has been made in order to solve at least some of the foregoing problems, and can be implemented in the following modes or application examples.

(1) According to a mode of the invention, a liquid container is provided. This liquid container includes: a liquid containing portion that is flexible and contains the liquid, the liquid containing portion having a first end and a second end that opposes the first end; a liquid leading portion for leading the liquid in the liquid containing portion to the liquid ejection apparatus, the liquid leading portion being attached to the first end; a liquid flow tube that has a base end connected to the liquid leading portion, the liquid flow tube extending within the liquid containing portion from the liquid leading portion toward the second end; and a spacer member that is provided in the liquid containing portion and has a spacer body forming a liquid-retaining space for retaining the liquid in the liquid containing portion. The spacer member is coupled to the liquid leading portion. The liquid flow tube is coupled to the spacer member.

According to this mode, as a result of having the spacer member, the high-concentration liquid that contains a large amount of the precipitating component remaining in the liquid containing portion can be retained in the liquid containing portion. Due to the liquid flow tube being coupled to the spacer member that is coupled to the liquid leading portion, the position of the liquid flow tube in the liquid containing portion is less likely to be unstable. As a result, the liquid at a desired position in the liquid containing position in the liquid containing portion can be supplied to the liquid ejection apparatus via the liquid flow tube. In addition, since high-concentration liquid can be retained in the liquid containing portion, the concentration in the liquid supplied to the liquid ejection apparatus is less likely to be uneven.

(2) In the above mode, the liquid flow tube may have a leading end at which an introduction port for introducing the liquid to the inside thereof is formed. A position at which the liquid flow tube is coupled to the spacer member may be located on the leading end side relative to a center of the liquid flow tube in a direction parallel to the liquid flow tube.

According to this mode, since the connecting position is on the leading end side relative to the center of the liquid flow tube, the position of the leading end that forms the introduction port in the liquid containing portion is less likely to be unstable. As a result, the liquid at a desired position in the liquid containing portion can be stably supplied to the liquid ejection apparatus via the liquid flow tube.

(3) In the above mode, in an orientation in which the liquid container is attached to the liquid ejection apparatus, the liquid flow tube may be configured to extend in a horizontal direction from the liquid leading portion within the liquid containing portion. The liquid flow tube may have a first flow passage and a second flow passage. The first flow passage may have a first base end that is in communication with the liquid leading portion, and a first leading end that forms a first introduction port that introduces the liquid in the liquid containing portion into the first flow passage. The second flow passage may have a second base end that is in communication with the liquid leading portion, and a second leading end that forms a second introduction port that introduces the liquid in the liquid containing portion into the second flow passage. In the orientation, the first introduction port may be located above the second introduction port.

According to this mode, the low-concentration liquid and the high-concentration liquid can be caused to flow toward the liquid leading portion using the first flow passage and second flow passage, respectively. As a result, a liquid that is a mixture of the low-concentration liquid and high-concentration liquid is led from the liquid leading portion toward the liquid ejection apparatus. Accordingly, a liquid with a more stable concentration can be supplied to the liquid ejection apparatus.

(4) In the above mode, the first introduction port and the second introduction port may be movable relative to the spacer body. A distance between the first introduction port and the second introduction port may gradually decrease as the liquid in the liquid containing portion is consumed and a volume of the liquid containing portion decreases.

According to this mode, the distance between the first introduction port and second introduction port gradually decreases as the liquid in the liquid containing portion is consumed and the volume of the liquid containing portion decreases. As a result, the concentration in the liquid introduced from the first introduction port and the concentration in the liquid introduced from the second introduction port are less likely to be greatly different. As a result, the concentration in the liquid supplied to the liquid ejection apparatus is even less likely to be uneven. In addition, since the first introduction port and second introduction port are individually movable relative to the spacer body, a common liquid flow tube can be used for liquid containers having liquid containing portion with different sizes. For example, by manufacturing a liquid flow tube so as to fit a liquid containing portion whose length in the up-down direction is largest, the thus-manufactured liquid flow tube can also be used for other liquid containing portions.

(5) In the above mode, positions of the first leading end and the second leading end relative to the spacer member may be fixed regardless of a change in the volume of the liquid containing portion.

According to this mode, even if the volume of the liquid containing portion has changed and the shape thereof has also changed in various manners, the positions of the first leading end and second leading end relative to the spacer member can be maintained. As a result, the liquid at a desired position in the liquid containing portion can be more stably supplied to the liquid ejection apparatus via the first flow passage and second flow passage.

(6) In the above mode, the first leading end and the second leading end may be fixed to the spacer member.

According to this mode, even if the liquid container receives an impact due to the liquid container falling at the time of transportation, for example, the first leading end and second leading end are less likely to come off of the spacer member.

(7) In the above mode, in an orientation in which the liquid container is attached to the liquid ejection apparatus, the liquid flow tube may be configured to extend to a side in a gravity direction from the liquid leading portion. In the orientation, the spacer body may have a portion located below the liquid flow tube.

According to this mode, higher-concentration liquid in the liquid containing portion can be retained in the liquid containing portion using the liquid-retaining space in the spacer body.

(8) In the above mode, the liquid flow tube may have a leading end that forms an introduction port for introducing the liquid in the liquid container to the inside thereof. The leading end may be fixed to the spacer member.

According to this mode, even if the liquid container receives an impact due to the liquid container falling at the time of transportation, for example, the leading end is less likely to come off of the spacer member.

(9) In the above mode, assuming that three orthogonal directions are an X direction, a Y direction, and a Z direction, a size of the spacer body may be smaller than a size of the liquid leading portion in at least one of the three directions.

According to this mode, it is possible to suppress an increase in the size of the liquid containing portion after the liquid in the liquid containing portion has been consumed with liquid remaining in the spacer member left.

(10) In the above mode, the spacer member may have a center beam that extends in a first direction parallel to a direction moving from the first end side toward the second end side of the liquid containing portion, a first edge beam and a second edge beam that extend in the first direction, the first edge beam and the second edge beam being arranged at positions on both sides of the center beam in a second direction perpendicular to the first direction, and comb teeth that connect the center beam to the first edge beam and also connect the center beam to the second edge beam, the comb teeth including a plurality of through holes passing through in a third direction perpendicular to the first direction and second direction.

According to this mode, due to the center beam, first edge beam, and second edge beam, the spacer member can have a rigidity with which it can maintain the shape in a state where no external force is applied thereto by a user or the like. In addition, as a result of having the comb teeth in which a plurality of through holes are formed, the spacer member can deform following the deformation of the liquid containing portion even if an external force that may deform the shape of the liquid containing portion is applied thereto.

(11) In the above mode, in an orientation in which the liquid container is attached to the liquid ejection apparatus, the third direction may be a direction parallel to a gravity direction.

According to this mode, liquid that is present on the upper side and on the lower side relative to the spacer member in the liquid containing portion can flow toward the respective opposite sides through the plurality of through holes. As a result, the concentration distribution in the liquid in the liquid containing portion is less likely to be uneven.

Note that the invention can also be implemented in various modes, and can be implemented not only in the mode of the liquid container, but also in the modes such as a method for manufacturing a liquid container, a liquid ejection system that includes a liquid container and a liquid ejection apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
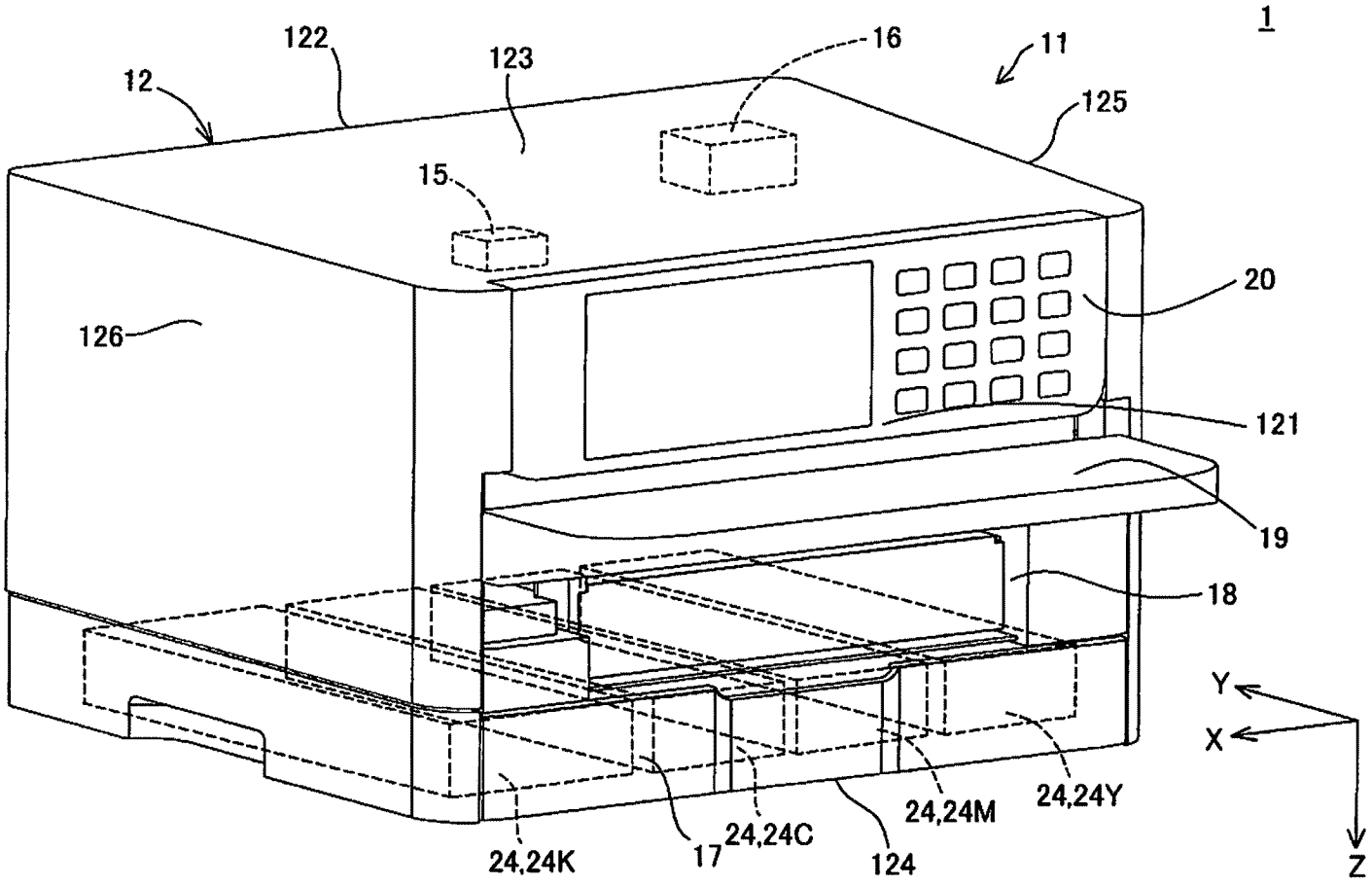
FIG. 1 is a perspective view of a liquid ejection system that includes liquid containers according to a first embodiment.
Figure 2:
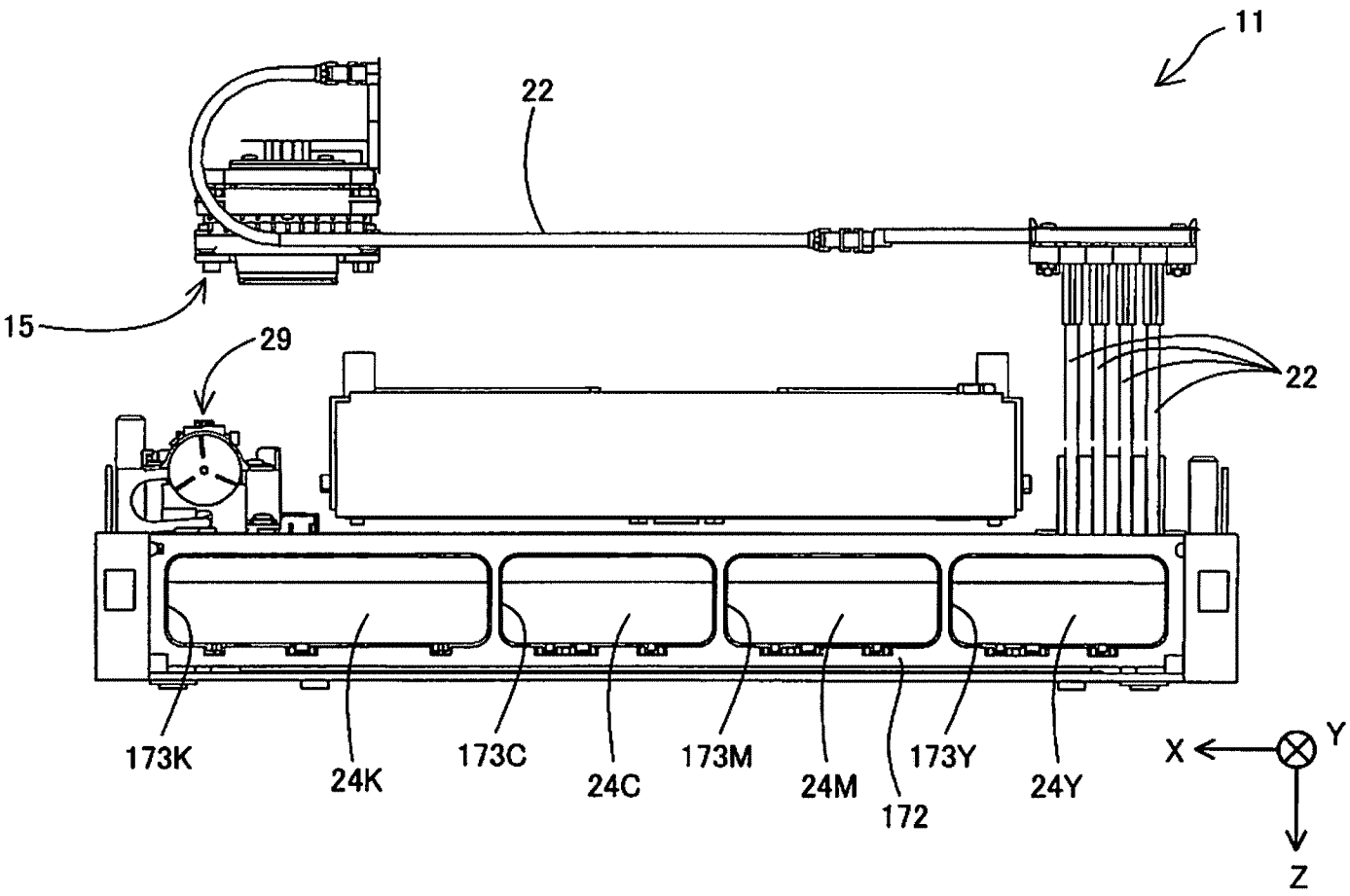
FIG. 2 partially shows a liquid ejection system as viewed from the front.
Figure 3:
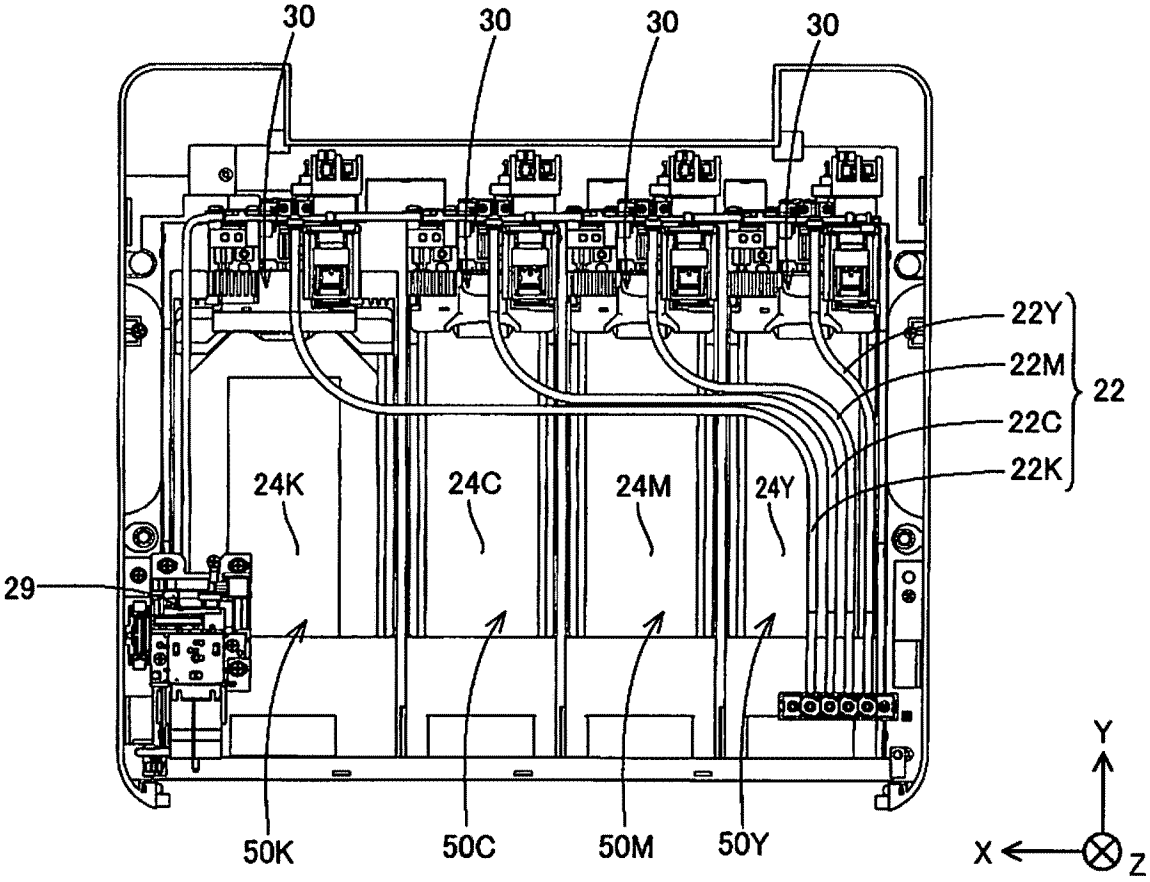
FIG. 3 partially shows the liquid ejection system as viewed from above.
Figure 4:
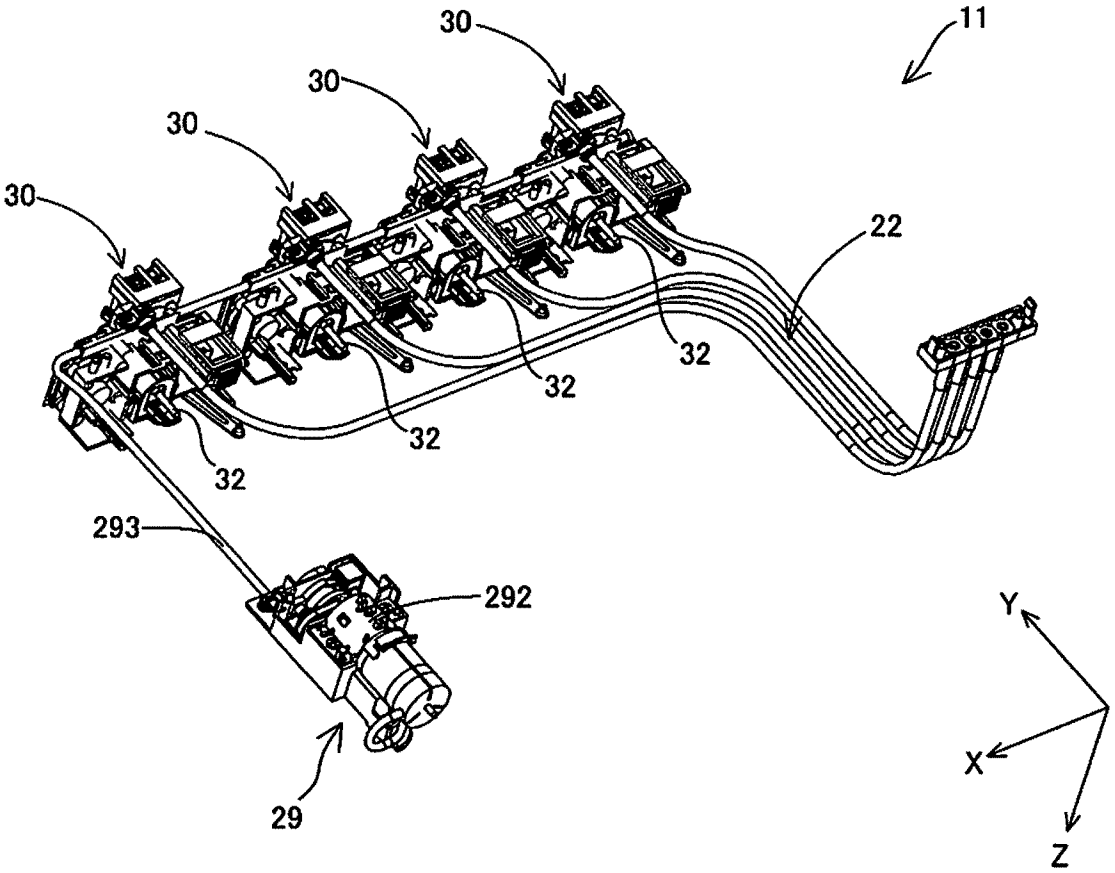
FIG. 4 is a diagram illustrating an internal configuration of a liquid ejection apparatus.

A-1: Configuration of Liquid Ejection System:

FIG. 1 is a perspective view of a liquid ejection system 1, which includes liquid containers 24 according to the first embodiment of the invention. FIG. 2 partially shows the liquid ejection system 1 as viewed from the front. FIG. 3 partially shows the liquid ejection system 1 as viewed from above. FIG. 4 is a diagram illustrating an internal configuration of a liquid ejection apparatus 11. In FIGS. 1 to 4, an X axis, a Y axis, and a Z axis, which are orthogonal to one another, are indicated. In this specification, it is assumed that an X direction is a direction parallel to an X-axis direction, a Y direction is a direction parallel to a Y-axis direction, and a Z direction is a direction parallel to a Z-axis direction. The X axis, Y axis, and Z axis that correspond to those in FIGS. 1 to 4 are also indicated in the other diagrams as required.

The liquid ejection system 1 (FIG. 1) includes a liquid ejection apparatus 11, and liquid containers 24 for supplying liquid to the liquid ejection apparatus 11.

Four liquid containers 24 are provided. When the four liquid containers 24 are distinguished, signs "24K", "24C", "24M", and "24Y" will be used. The four liquid containers 24K to 24Y contain (are filled with) different types of liquid. In this embodiment, yellow (Y), magenta (M), cyan (C), and black (K) liquid is contained in different liquid containers, namely the liquid containers 24K to 24Y, respectively. The liquid container 24K contains black liquid. The liquid container 24C contains cyan liquid. The liquid container 24M contains magenta liquid. The liquid container 24Y contains yellow liquid. The liquid container 24K can contain a greater amount of liquid than each of the liquid containers 24C, 24M, and 24Y. The liquid contained in the liquid containers 24K to 24Y is ink that contains a precipitating component. The precipitating component is a pigment that is used as a coloring matter, for example. The pigment is dispersed in an ink solvent in the ink contained in the liquid containers 24K to 24Y. A detailed configuration of the liquid containers 24 will be described later.

The liquid ejection apparatus 11 is an inkjet printer that records (prints) by ejecting the ink, which is an example of liquid, to a medium such as printing paper. When the liquid ejection apparatus 11 is installed on a horizontal surface that is parallel to the X direction and Y direction, the +Z direction is the gravity direction, and the −Z direction is the antigravity direction.

The liquid ejection apparatus 11 has an exterior body 12, whose height, depth, and width are respective given lengths when the liquid ejection apparatus 11 is in a state of being installed on a horizontal surface (installed state). The exterior body 12 has a substantially rectangular-parallelepiped shape. The exterior body 12 has an apparatus front face (apparatus first face, apparatus first wall) 121, an apparatus rear face (apparatus second face, apparatus second wall) 122, an apparatus upper face (apparatus third face, apparatus third wall) 123, an apparatus bottom face (apparatus fourth face, apparatus fourth wall) 124, an apparatus right side face (apparatus fifth face, apparatus fifth wall) 125, and an apparatus left side face (apparatus sixth face, apparatus sixth wall) 126. The faces 121 to 126 form the outer shell of the exterior body 12.

The apparatus front face 121 and apparatus rear face 122 oppose each other. The apparatus upper face 123 and apparatus bottom face 124 oppose each other. The apparatus right side face 125 and apparatus left side face 126 oppose each other. The apparatus front face 121, apparatus rear face 122, apparatus right side face 125, and apparatus left side face 126 are faces that are substantially perpendicular to the installation surface when the liquid ejection apparatus 11 is in an installed stated. The apparatus upper face 123 and apparatus bottom face 124 are faces that are substantially parallel to the installation surface when the liquid ejection apparatus 11 is in an installed state. Here, being "substantially perpendicular" or being "substantially parallel" means being almost "perpendicular" or "parallel" as well as being completely "perpendicular" or "parallel". That is to say, the faces 121 to 126 are faces that are not completely flat but include projections, recesses, or the like, and need only be almost "perpendicular" or almost "parallel" in the appearance.

The X direction is a direction in which the apparatus right side face 125 and the apparatus left side face 126 oppose each other. The Y direction is a direction in which the apparatus front face 121 and the apparatus rear face 122 oppose each other. The Z direction is a direction in which the apparatus upper face 123 and the apparatus bottom face 124 oppose each other. The X direction is the "width direction" of the liquid ejection apparatus 11. The Y direction is the "depth direction" of the liquid ejection apparatus 11. The Z direction is the "height direction (up-down direction)" of the liquid ejection apparatus 11.

The liquid ejection apparatus 11 also has an ejecting portion 15, a controller 16, and tubes 22 (FIG. 3). The ejecting portion 15, controller 16, and tubes 22 are arranged within the exterior body 12.

The tubes 22 bring the ejecting portion 15 into communication with the liquid containers 24. The tubes 22 are flexible members. Four tubes 22 (FIG. 3) are provided corresponding to the four liquid containers 24K to 24Y. The black ink supplied from the liquid container 24K flows through the tube 22K. The cyan ink supplied from the liquid container 24C flows through the tube 22C. The magenta ink supplied from the liquid container 24M flows through the tube 22M. The yellow ink supplied from the liquid container 24Y flows through the tube 22Y.

The ejecting portion 15 is moved back and forth in the X direction by a drive mechanism (not shown). The ejecting portion 15 performs recording (prints) by ejecting the ink supplied from the liquid containers 24 via the tubes 22 onto a recording medium. Specifically, when ejecting ink onto the recording medium to perform recording, the ejecting portion 15 moves back and forth in the X direction, and the recording medium is moved in the −Y direction within the exterior body 12 by a conveyance mechanism (not shown). In another embodiment, the ejecting portion 15 may be a line head that does not move back and forth and whose position is fixed.

The controller 16 (FIG. 1) controls the operations of the liquid ejection apparatus 11. For example, the controller 16 controls the operations of the aforementioned drive mechanism and conveyance mechanism. The controller 16 is electrically connected to the liquid containers 24, and can exchange various kinds of information with the liquid containers 24. Various kinds of information may include information regarding ink colors of the liquid containers 24, and information indicating whether or not the liquid containers 24 are attached to the liquid ejection apparatus 11, for example.

The liquid ejection apparatus 11 (FIG. 1) has a front lid 17, a paper feed opening 18, a discharge tray 19, and an operation panel 20, which are arranged on the apparatus front face 121 side. The front lid 17, paper feed opening 18, discharge tray 19, and operation panel 20 are arranged in this order from the apparatus bottom face 124 side toward the apparatus upper face 123 side.

The front lid 17 is configured so that the upper end thereof can rotate around the lower end thereof, which serves as a fulcrum. The front lid 17 is opened and closed by rotating the upper end. By opening the front lid 17, an attachment wall 172, which is provided in the liquid ejection apparatus 11, is exposed to the outside, as shown in FIG. 2. Openings 173K to 173Y for attaching and removing the liquid containers 24 to and from the liquid ejection apparatus 11 are formed in the attachment wall 172. The liquid containers 24K to 24Y, when attached and detached, pass through the corresponding openings 173K to 173Y. Accommodating spaces 50K to 50Y are formed, with the attachment wall 172 on their front side, are formed (FIG. 3) within the exterior body 12. The accommodating space 50K accommodates the liquid container 24K. The accommodating space 50C accommodates the liquid container 24C. The accommodating space 50M accommodates the liquid container 24M. The accommodating space 50Y accommodates the liquid container 24Y. The direction in which the liquid containers 24 are attached to the liquid ejection apparatus 11 is the +Y direction. The direction in which the liquid containers 24 are removed therefrom is the −Y direction.

The paper feed opening 18 (FIG. 1) is an opening for arranging recording mediums (e.g. paper) within the exterior body 12. The discharge tray 19 is a portion where recording mediums after being subjected to recording are discharged. The operation panel 20 accepts an instruction to operate the liquid ejection apparatus 11 (e.g. an instruction to turn on/off the power and the number of copies) from the outside.

The liquid ejection apparatus 11 (FIG. 4) also includes a supply mechanism 29 and connection mechanisms 30. The supply mechanism 29 and connection mechanism 30 are arranged within the exterior body 12.

When the liquid containers 24 are in a state of being attached to the liquid ejection apparatus 11 (attached state), the connection mechanisms 30 are connected to the liquid containers 24. Four connection mechanisms 30 are provided corresponding to the accommodating spaces 50K to 50Y. The connection mechanisms 30 are arranged on the apparatus rear face 122 side in the housing space portions 50K to 50Y. The connection mechanisms 30 each have a liquid introduction tube 32, which extends in the Y direction. The liquid introduction tube 32 is connected to a later-described liquid leading portion of the corresponding liquid container 24. The ink that has flown out of the liquid leading portion flows through the liquid introduction tube 32. The ink that flows through the liquid introduction tube 32 is sent out to the ejecting portion 15 via the corresponding tube 22, due to an operation of the supply mechanism 29. The connection mechanisms 30 each also include a terminal (not shown), which is electrically connected to a later-described circuit board of the corresponding liquid container 24 when the liquid container 24 is in an attached state.

The supply mechanism 29 is a mechanism that suctions the ink in the liquid containers 24 that are connected to the liquid introduction tubes 32, and sends out the ink that has flown into the liquid introduction tubes 32 to the ejecting portion 15 via the tubes 22. The supply mechanism 29 has a pressure change portion 292 and a pressure transmission tube 293. A pressure change generated by the pressure change portion 292 is transmitted to the connection mechanisms 30 via the pressure transmission tube 293. Using this pressure change, the connection mechanisms 30 repeat suctioning of the ink contained in the liquid containers 24 and sending out the suctioned ink to the tubes 22 to supply the ink to the ejecting portion 15.

Figure 5:
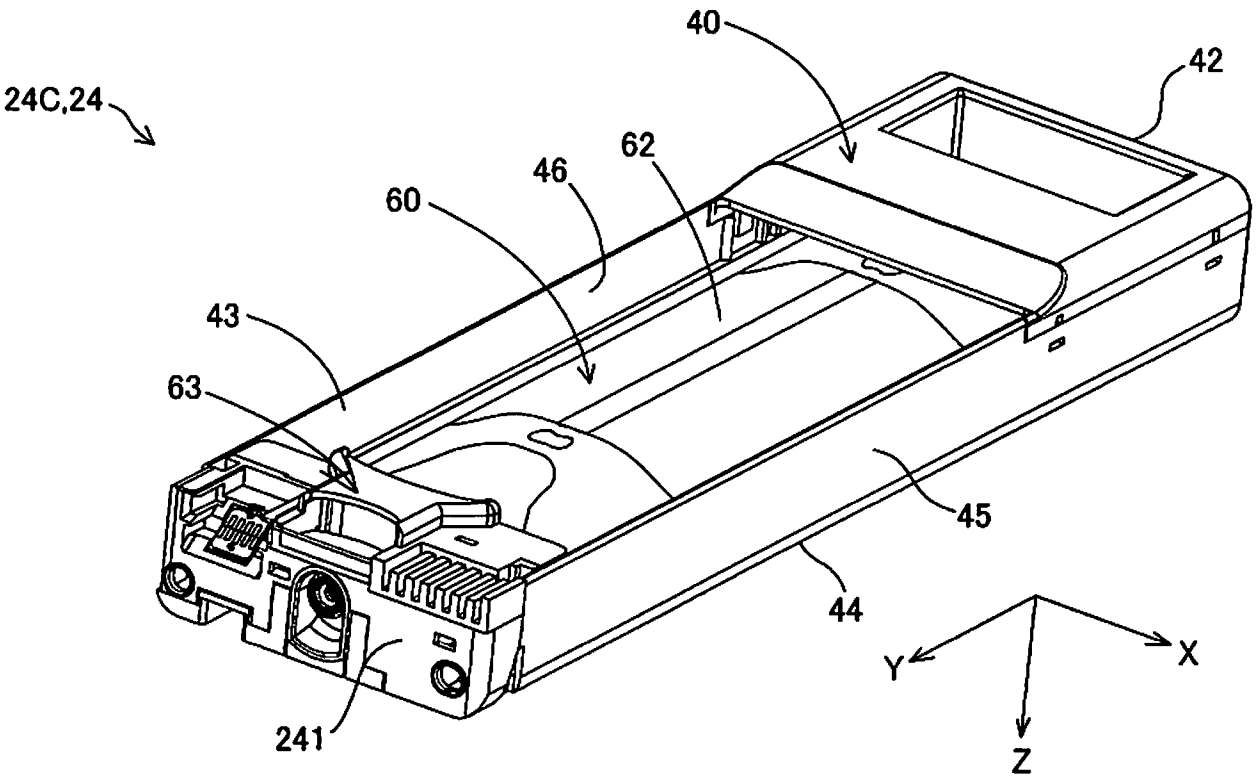
FIG. 5 is an external view of the liquid container.
Figure 6:
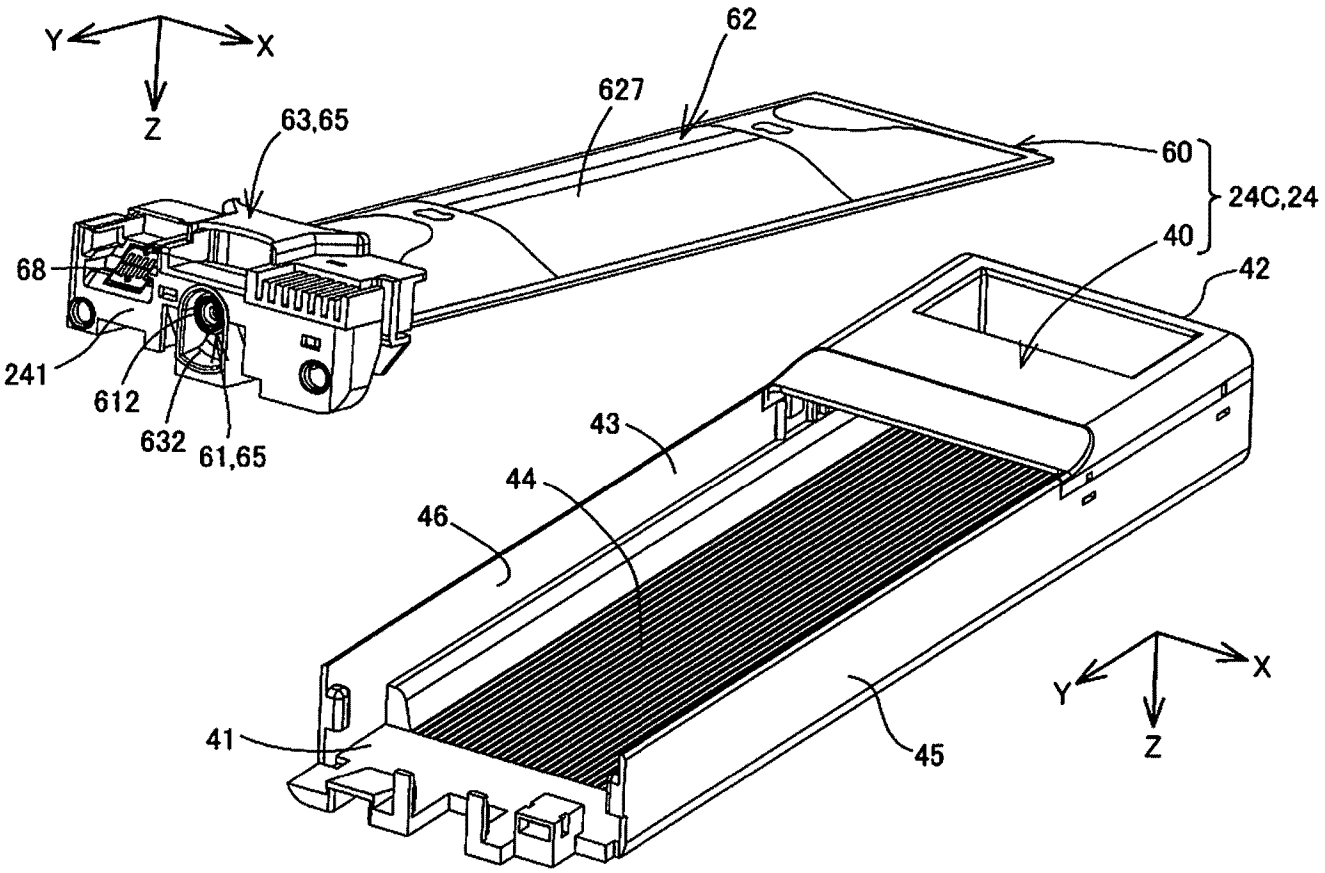
FIG. 6 is an exploded perspective view of the liquid container.
Figure 7:
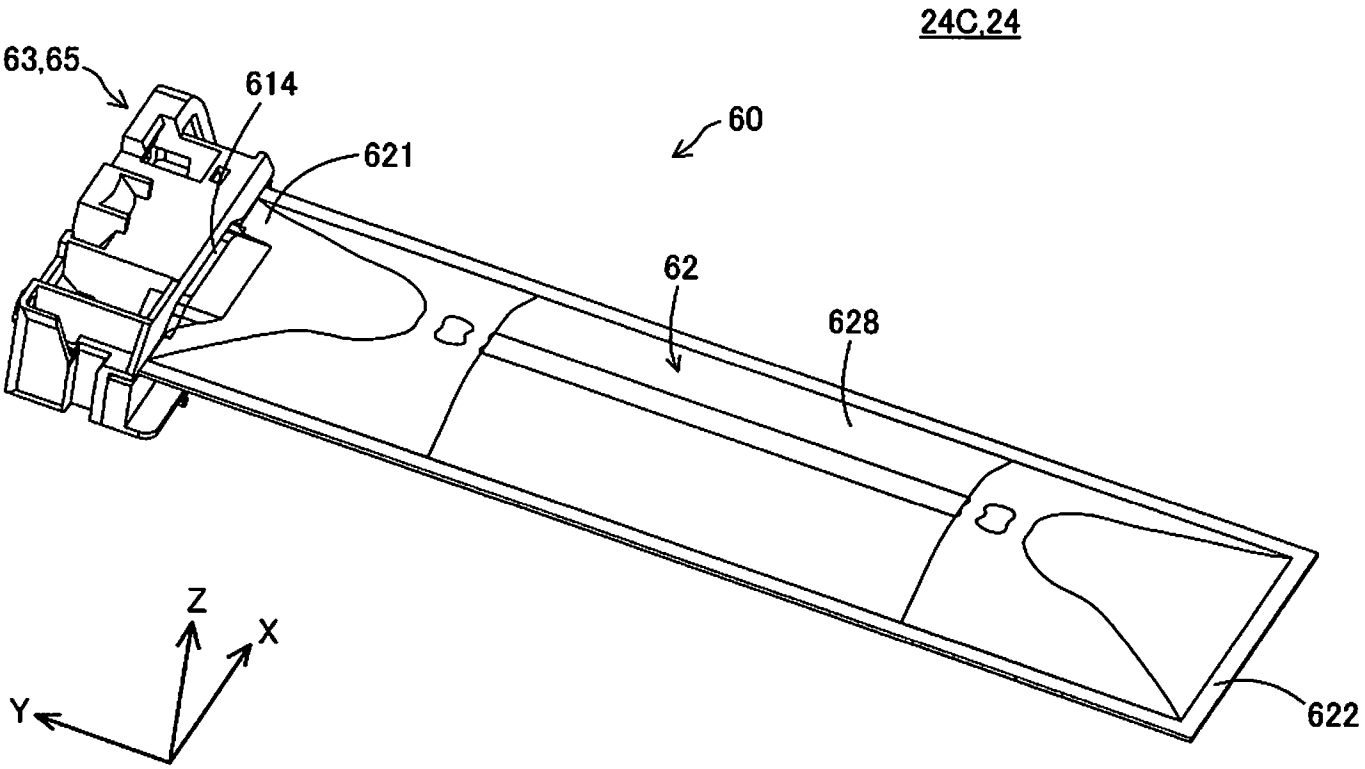
FIG. 7 is an external view of a container body.

A-2. Configuration of Liquid Container:

FIG. 5 is an external view of the liquid container 24C. FIG. 6 is an exploded perspective view of the liquid container 24C. FIG. 7 is an external view of the container body 60. Although the liquid container 24C for containing the cyan ink will be described below, the liquid containers 24M and 24Y for containing the other color inks also have the same configuration. The liquid container 24K for containing the black ink has a greater length in the X direction than that of the liquid containers 24C, 24M, and 24Y so as to be able to contain a greater amount of ink. However, the liquid container 24K also has the same configuration that will be described below using the liquid container 24C.

The liquid container 24C (FIG. 5) includes a container body 60 and a case 40. The container body 60 and case 40 form a substantially rectangular-parallelepiped external appearance of the liquid container 24C. The liquid container 24C includes a front face (first face, first wall) 241, a rear face (second face, second wall) 42, an upper face (third face, third wall) 43, a bottom face (fourth face, fourth wall) 44, a right side face (fifth face, fifth wall) 45, and a left side face (sixth face, sixth wall) 46. The upper face 43 is partially open, from which a liquid containing portion 62 of the liquid container 24C is exposed.

The front face 241 and rear face 42 oppose each other. The upper face 43 and bottom face 44 oppose each other. The right side face 45 and left side face 46 oppose each other. The rear face 42, right side face 45, and left side face 46 stand upright from the bottom face 44. The front face 241 is located on the leading end side in the attaching direction (+Y direction). The direction in which the right side face 45 and left side face 46 oppose each other is the X direction. The direction in which the front face 241 and rear face 42 oppose each other is the Y direction. The direction in which the upper face 43 and bottom face 44 oppose each other is the Z direction. The X direction is the "width direction" of the liquid container 24C. The Y direction is the "depth direction" of the liquid container 24C. The Z direction is the "height direction (thickness direction)" of the liquid container 24C. Regarding the liquid containers 24K, 24C, 24M, and 24Y according to this embodiment, the length in the height direction is the shortest, and the length in the depth direction is the longest.

The case 40 (FIG. 6) has a recessed shape. The case 40 mainly forms the rear face 42, upper face 43, bottom face 44, right side face 45, and left side face 46 of the liquid container 24. An opening portion 41 is formed in the case 40 on the side opposing the rear face 42. The liquid containing portion 62 of the container body 60 is accommodated in the case 40.

The container body 60 (FIG. 6) includes the liquid containing portion 62 and the connecting member 65. The liquid containing portion 62 contains ink, which is a liquid. The liquid containing portion 62 is a flexible member. The liquid containing portion 62 has a bag-like shape, and is formed by sticking a plurality of films to one another. In this embodiment, the liquid containing portion 62 is formed by overlapping two films, joining a part of a peripheral portion of one film to that of the other film, and also joining another part of the peripheral portions to a joint portion 614 (FIG. 7) of the connecting member 65, by means of a method such as thermal welding. The films constituting the liquid containing portion 62 are made of a material that is flexible and has gas barrier properties. For example, the film material may be polyethylene terephthalate (PET), nylon, polyethylene, or the like. The films may be formed using a laminated structure in which a plurality of films made of such a material are laminated. In such a laminated structure, for example, an outer layer may be made of PET or nylon, which has excellent impact-resistance, and an inner layer may be made of polyethylene, which has an excellent ink-proof property. Furthermore, a film having a layer to which aluminum or the like is evaporated may be used as a constituent member of the laminate structure.

The liquid containing portion 62 has a first face 627 (FIG. 6), which forms a top face, and a second face 628 (FIG. 7), which forms a bottom face. The first face 627 is constituted by a single film. The second face 628 is constituted by another single film. The liquid containing portion 62 has a first end 621 and a second end 622 that opposes the first end 621. The first end 621 is the end on the side in the attaching direction (+Y direction). The second end 622 is the end on the side in the removing direction (−Y direction).

The connecting member 65 (FIG. 7) is located on the first end 621 side of the liquid containing portion 62. When the liquid container 24 is in the attached state, the connecting member 65 is connected to the connection mechanism 30 in the liquid ejection apparatus 11. The connecting member 65 has the liquid leading portion 61 and a cover portion 63 (FIG. 6).

In the attached state, the liquid leading portion 61 is connected to the liquid introduction tube 32 (FIG. 4). The liquid leading portion 61 is integrally molded using a synthetic resin, such as polyethylene or polypropylene. The liquid leading portion 61 is in communication with the liquid containing portion 62. The liquid leading portion 61 leads the ink (liquid) in the liquid containing portion 62 to the liquid ejection apparatus 11 (specifically, liquid introduction tube 32). An opening 612 is formed at the end of the liquid leading portion 61 on the downstream side in the direction in which the ink flows from the liquid containing portion 62 to the outside (e.g. liquid introduction tube 32). The ink flows to the outside through the opening 612. A detailed configuration of the liquid leading portion 61 will be described later.

The cover portion 63 is fixed to the liquid leading portion 61. The cover portion 63 is fixed to the opening portion 41 of the case 40. The cover portion 63 has an arrangement opening portion 632 and a circuit board 68. The arrangement opening portion 632 is an opening that passes through the cover portion 63 in the Y direction. A portion of the liquid leading portion (including the opening 612) is arranged in the arrangement opening portion 632. A contact portion that comes into contact with a terminal in the connection mechanism 30 to be electrically connected thereto is formed on the surface of the circuit board 68. A storage unit in which various kinds of information (e.g. ink color information) is stored is arranged on the back face of the circuit board 68.

Figure 8:
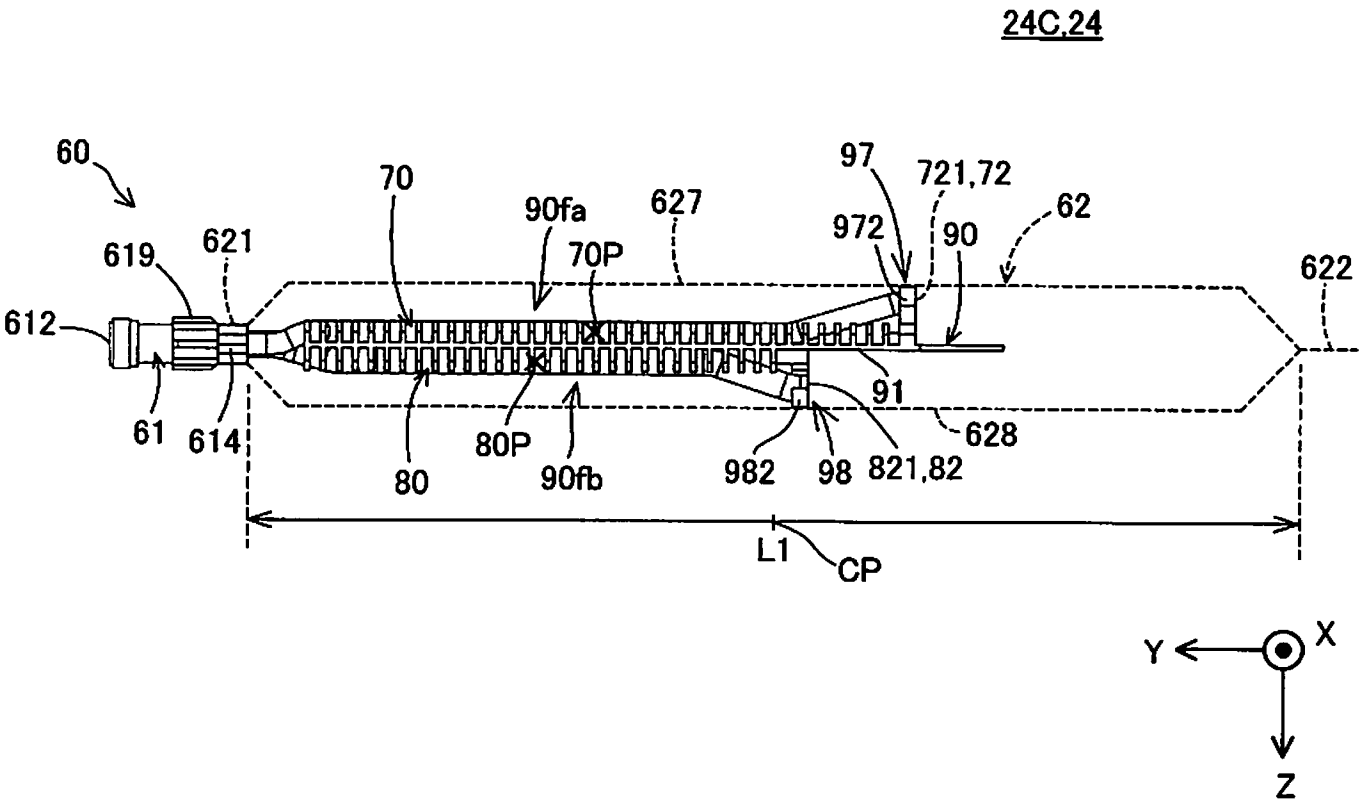
FIG. 8 shows an internal configuration of a liquid leading portion and a liquid containing portion of the container body.
Figure 9:
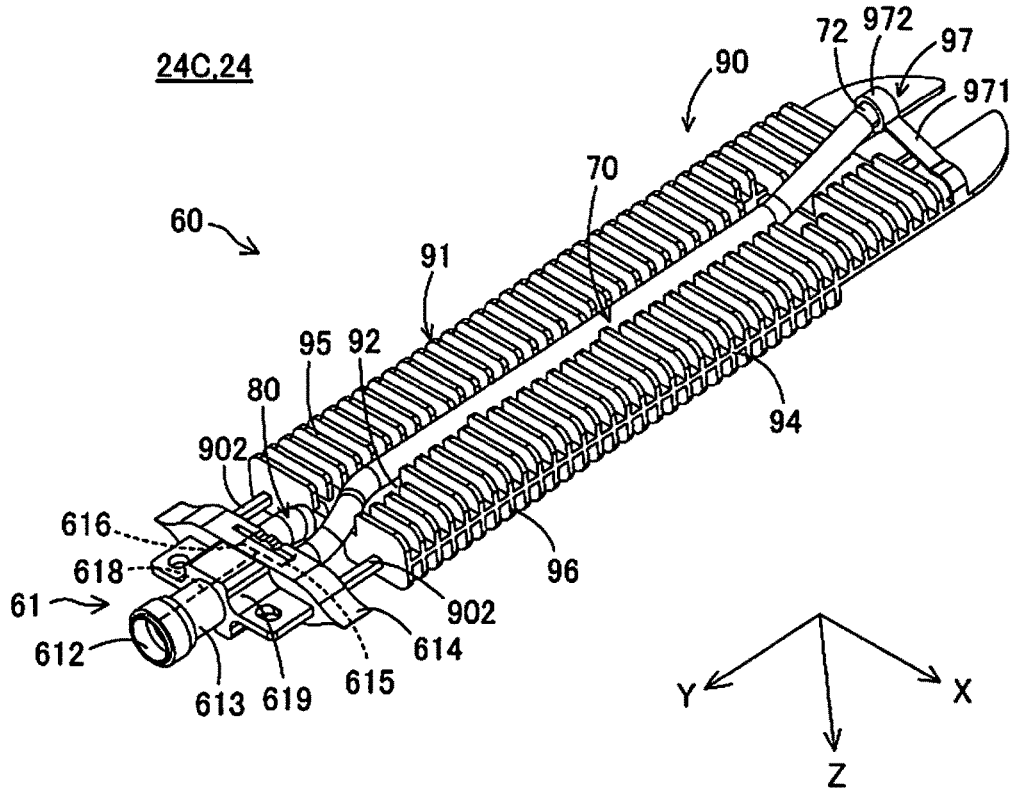
FIG. 9 is a first perspective view showing an internal configuration of the liquid leading portion and the liquid containing portion.
Figure 10:
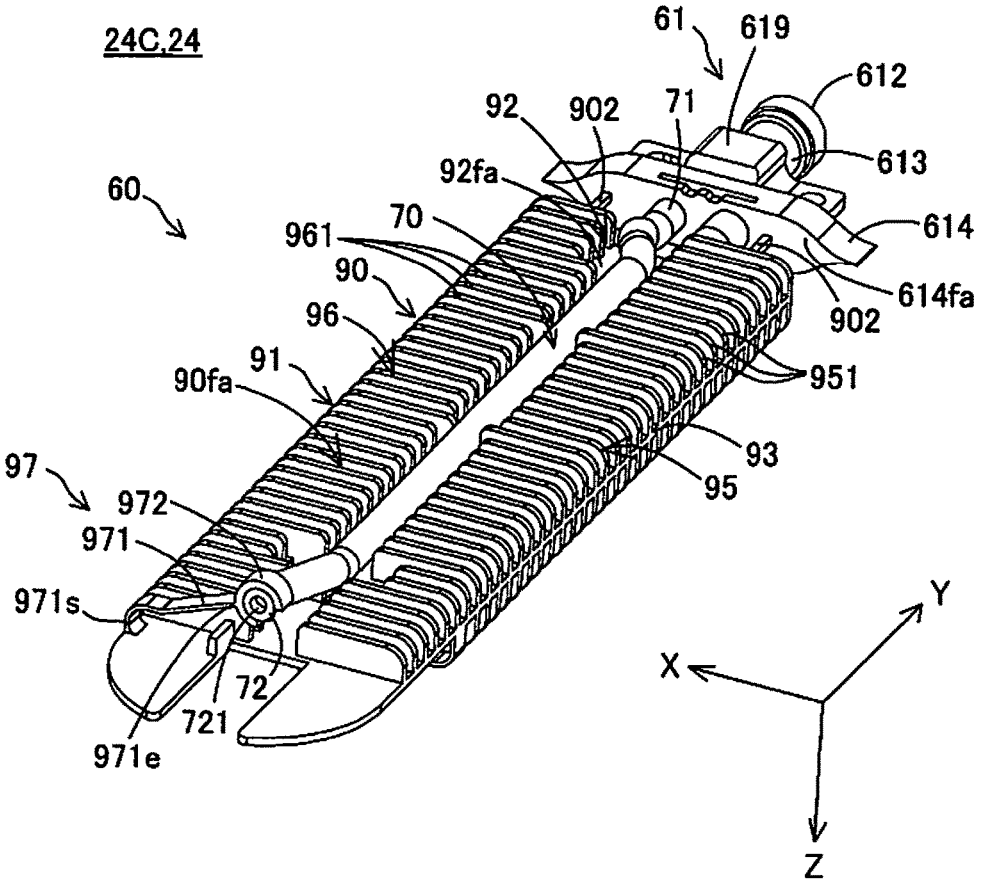
FIG. 10 is a second perspective view showing an internal configuration of the liquid leading portion and the liquid containing portion.
Figure 11:
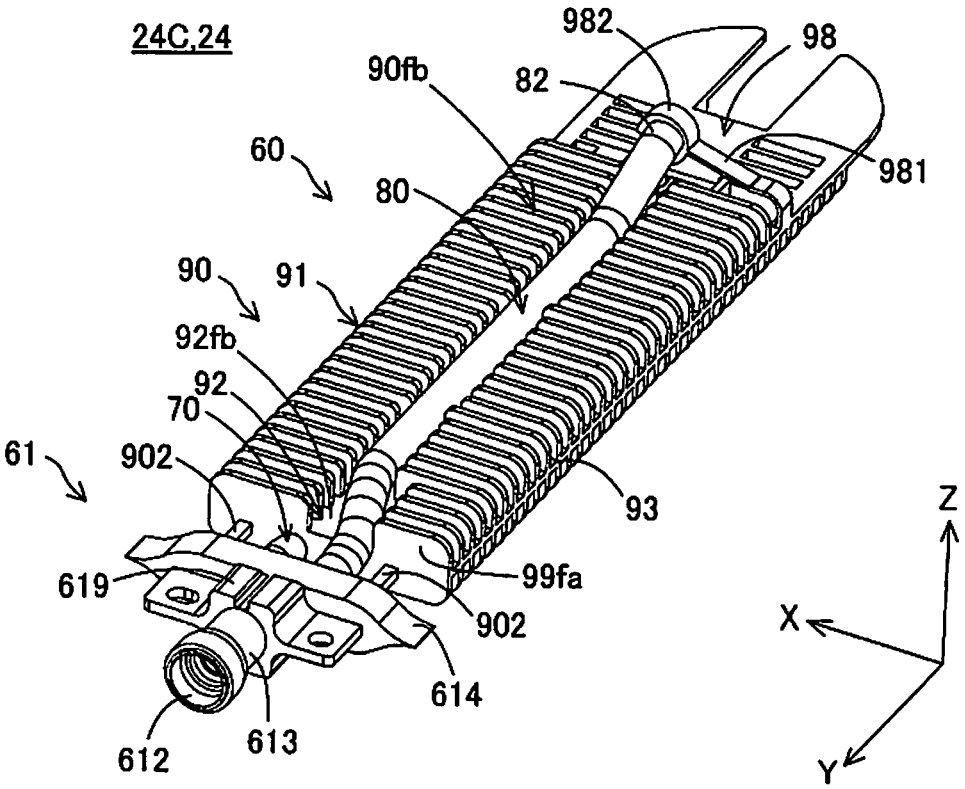
FIG. 11 is a third perspective view showing an internal configuration of the liquid leading portion and the liquid containing portion.
Figure 12:
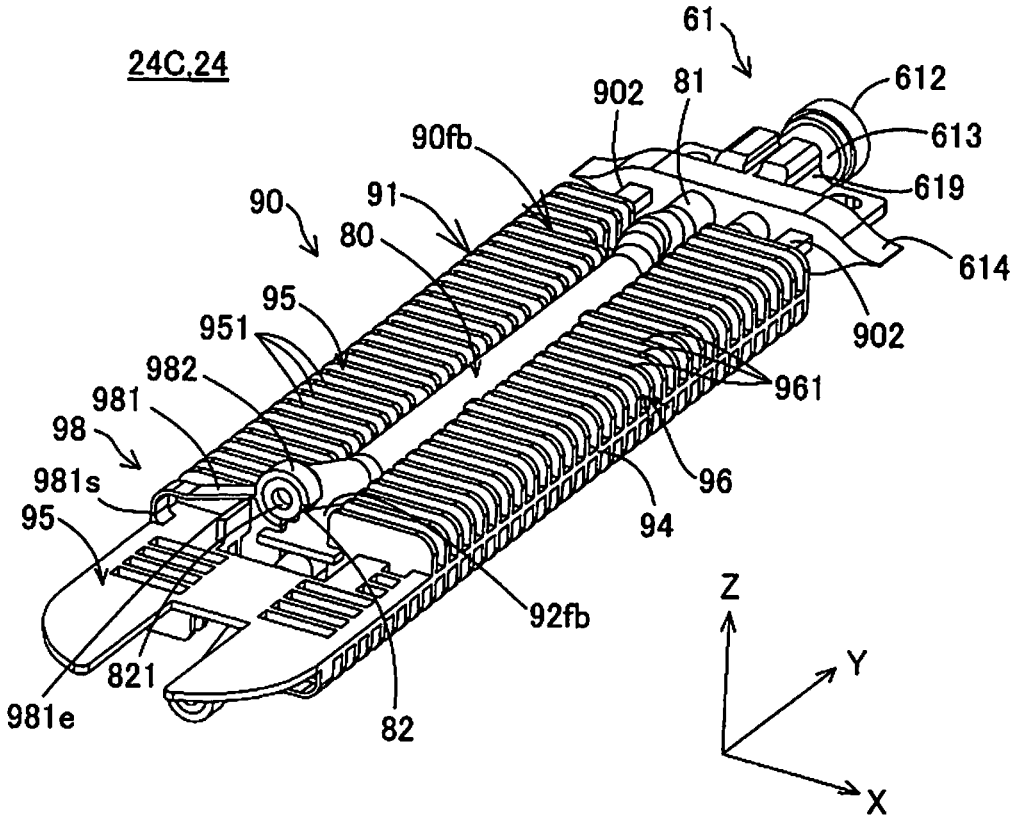
FIG. 12 is a fourth perspective view showing an internal configuration of the liquid leading portion and the liquid containing portion.
Figure 13:
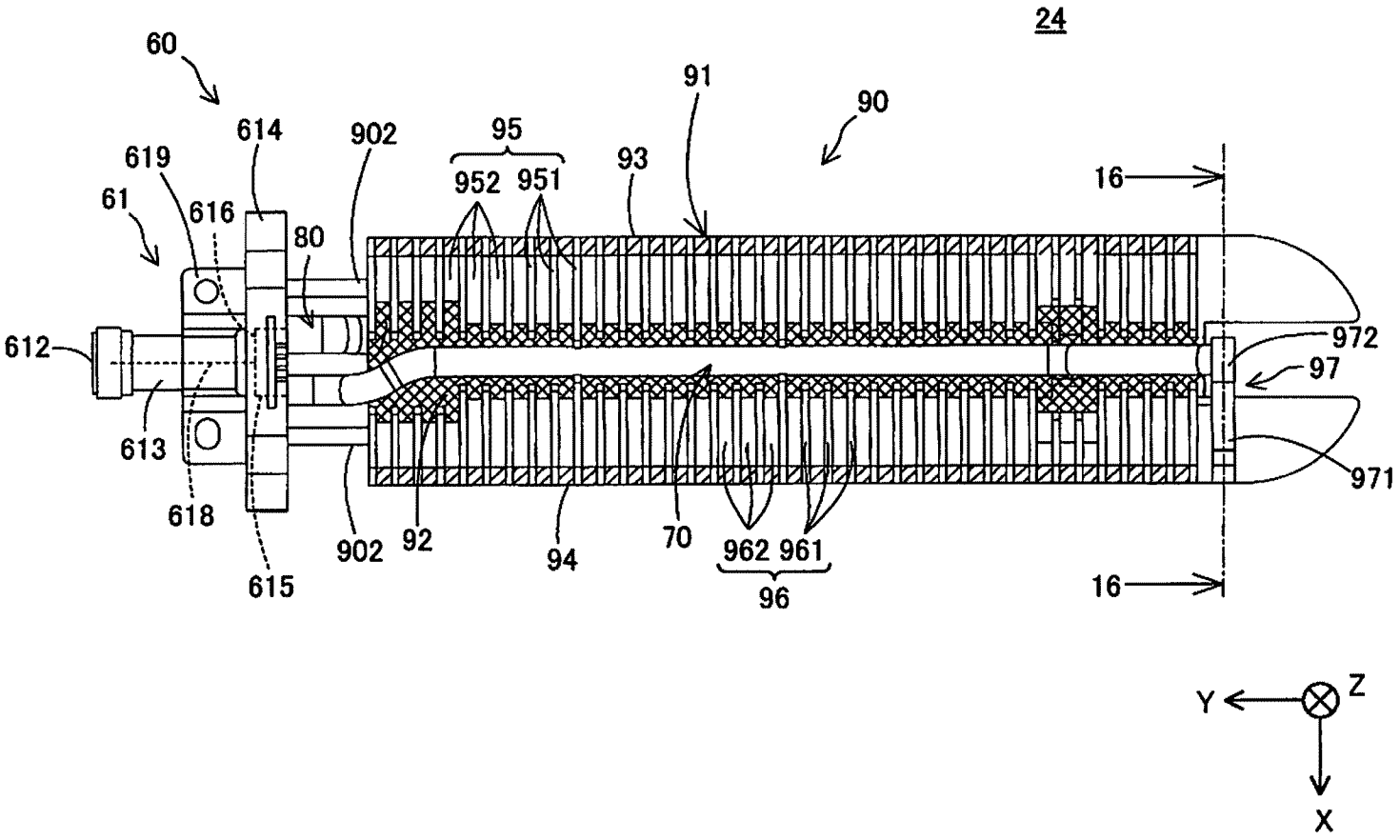
FIG. 13 is a fifth perspective view showing an internal configuration of the liquid leading portion and the liquid containing portion.
Figure 14:
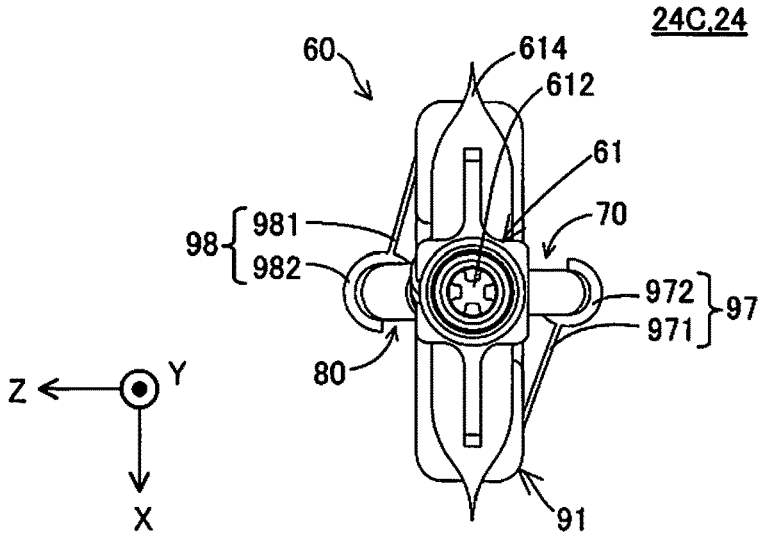
FIG. 14 is equivalent to the diagram in FIG. 8 as shown from the side in a +Y direction.
Figure 15:
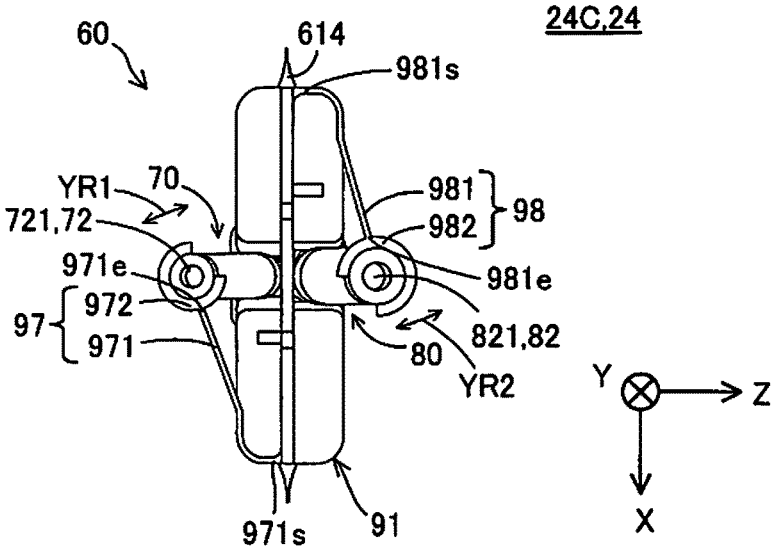
FIG. 15 is equivalent to the diagram in FIG. 8 as shown from the side in a −Y direction.
Figure 16:
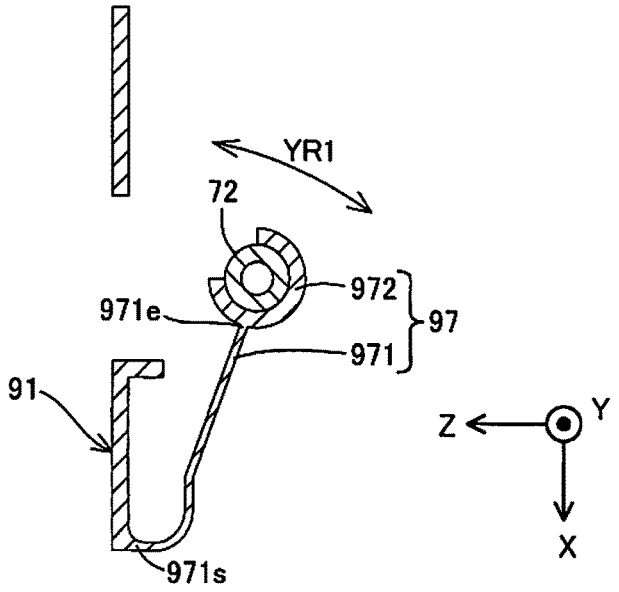
FIG. 16 is a cross-sectional view taken along line 16-16 in FIG. 13.

FIG. 8 shows an internal configuration of the liquid leading portion 61 and liquid containing portion 62 of the container body 60. FIG. 9 is a first perspective view showing the internal configuration of the liquid leading portion 61 and liquid containing portion 62. FIG. 10 is a second perspective view showing the internal configuration of the liquid leading portion 61 and liquid containing portion 62. FIG. 11 is a third perspective view showing the internal configuration of the liquid leading portion 61 and liquid containing portion 62. FIG. 12 is a fourth perspective view showing the internal configuration of the liquid leading portion 61 and liquid containing portion 62. FIG. 13 is a fifth perspective view showing the internal configuration of the liquid leading portion 61 and liquid containing portion 62. FIG. 14 is equivalent to the diagram in FIG. 8 as shown from the side in the +Y direction. FIG. 15 is equivalent to the diagram in FIG. 8 as shown from the side in the −Y direction. FIG. 16 is a cross-sectional view taken along line 16-16 in FIG. 13. The internal configuration of the liquid leading portion 61 and liquid containing portion 62 will be described using FIGS. 8 to 16. FIG. 8 shows a state (initial state) where the liquid containing portion 62 is filled with the ink, before the ink is consumed. FIGS. 9 to 16 show the liquid leading portion 61 and a spacer member 90 before being assembled into the liquid containing portion 62.

The liquid leading portion 61 (FIG. 9) has a leading end connecting portion 613, a joint portion 614, and an intermediate member 619. The leading end connecting portion 613 has a tubular shape, and forms the opening 612 at the end on the side in the +Y direction. A valve mechanism (not shown) for preventing leakage of the ink in the liquid containing portion 62 is arranged within the leading end connecting portion 613. The valve mechanism opens as a result of a valve body thereof being pressed by the liquid introduction tube 32 (FIG. 4) inserted into the leading end connecting portion 613 through the opening 612. The joint portion 614 is located at the end of the liquid leading portion 61 in the −Y direction. The joint portion 614 is sandwiched by two films (first face 627 and second face 628) that form the liquid containing portion 62, and is joined to these two films.

The intermediate member 619 is a member sandwiched by the leading end connecting portion 613 and the joint portion 614 in the +Y direction (attaching direction). The intermediate portion 619 is fitted to the cover portion 63 (FIG. 6).

Several kinds of flow passages, namely flow passages 615, 616, and 618 for allowing the liquid in the liquid containing portion 62 to flow up to the opening 612 are formed within the liquid leading portion 61. Ink from a later-described first flow passage 70 flows into a first branch flow passage 615. Ink from a later-described second flow passage portion 80 flows into a second branch flow passage 616. A confluent flow passage 618 is a flow passage where the first branch flow passage 615 and second branch flow passage 616 merge with each other. At least a portion of the confluent flow passage 618 is formed within the leading end connecting portion 613.

The liquid container 24C also includes liquid flow tubes 70 and 80 for guiding the ink in the liquid containing portion 62 to the liquid leading portion 61, and the spacer member 90 that forms through holes 952 and 962 (FIG. 13), which serve as liquid-retaining spaces for retaining the ink (liquid) in the liquid containing portion 62. The liquid flow tubes 70 and 80 and the spacer member 90 are provided in the liquid containing portion 62. The liquid flow tube 70 will also be called a first flow passage 70, and the liquid flow tube 80 will also be called a second flow passage 80. The liquid flow tubes 70 and 80 are connected to the spacer member 90.

The first flow passage 70 (FIG. 10) is a flexible tube. The first flow passage 70 has a first base end 71, which serves as a base end that is connected to the liquid leading portion 61. The first flow passage 70 extends from the liquid leading portion 61 toward the second end 622 (FIG. 8) side within the liquid containing portion 62. The first base end 71 is in communication with the first branch flow passage 615 of the liquid leading portion 61. In this embodiment, when the liquid container 24 is in an orientation of being attached to the liquid ejection apparatus 11 (attachment orientation), the first flow passage 70 serving as the liquid flow tube is configured to extend from the liquid leading portion 61 in the horizontal direction (Y direction) within the liquid containing portion 62. Here, "extending in the horizontal direction" need only mean extending substantially in the horizontal direction. Half the overall length of the first flow passage 70 or more may extend in the horizontal direction.

The first flow passage 70 (FIG. 10) has a first leading end 72, which serves as a leading end at which a first introduction port 721 is formed. The first introduction port 721 introduces the ink (liquid) in the liquid containing portion 62 into the first flow passage 70.

The second flow passage 80 (FIG. 12) is a flexible tube. The second flow passage 80 has a second base end 81, which serves as a base end that is connected to the liquid leading portion 61. The second flow passage 80 extends from the liquid leading portion 61 toward the second end 622 (FIG. 8) side within the liquid containing portion 62. The second base end 81 is in communication with the second branch flow passage 616 of the liquid leading portion 61. In this embodiment, when the liquid container 24C is in the attachment orientation, the second flow passage 80 serving as the liquid flow tube is configured to extend from the liquid leading portion 61 in the horizontal direction (Y direction) within the liquid containing portion 62. Here, "extending in the horizontal direction" need only mean extending substantially in the horizontal direction. Half the overall length of the second flow passage 80 or more may extend in the horizontal direction.

The second flow passage 80 (FIG. 11) has a second leading end 82, which serves as a leading end at which a second introduction port 821 is formed. The second introduction port 821 introduces the ink (liquid) in the liquid containing portion 62 into the second flow passage 80.

The spacer member 90 is in communication with the liquid leading portion 61 through coupling members 902. In this embodiment, a face 99*fa* (FIG. 11) of the spacer member 90 that faces the joint portion 614 is coupled to a face 614*fa* of the joint portion 614 that faces the spacer member 90, as a result of two coupling members 902 being connected. The coupling member 902 is a column-shaped member. The position of the spacer member 90 relative to the liquid leading portion 61 is fixed by the coupling member 902.

The spacer member 90 is integrally molded using a synthetic resin, such as polyethylene or polypropylene. The spacer member 90 (FIG. 9) has a spacer body 91, which has a flat shape, a first support member 97 for supporting the first flow passage 70, and a second support member 98 for supporting the second flow passage 80 (FIG. 12). The spacer member 90 (FIG. 8) faces, on one main face side 90*fa*, the first face 627 of the liquid containing portion 62. The spacer member 90 faces, on the other main face side 90*fb*, the second face 628 of the liquid containing portion 62. The first flow passage 70 serving as the liquid flow tube is supported by the first support member 97, thereby being coupled to the spacer member 90. The second flow passage 80 serving as the liquid flow tube is supported by the second support member 98, thereby being coupled to the spacer member 90.

The spacer body 91 forms the through holes 952 and 962 (FIG. 13), which serve as liquid-retaining spaces. The spacer body 91 has a rigidity that allows its shape to be maintained in a state where no external force is applied thereto by a user or the like. The spacer member 90 also has a rigidity that allows it to deform following deformation of the liquid containing portion 62 when an external force is applied to the liquid containing portion 62 by the user or the like. For example, if an external force that is a component in the Z direction, which is a direction in which the first face 627 and second face 628 of the liquid containing portion 62 oppose each other, is applied to the liquid containing portion 62, and the liquid containing portion 62 deforms so that a portion of the liquid containing portion 62 (e.g. on the first end 621 side) is displaced further in the −Z direction than another portion thereof (second end 622), the spacer body 91 deforms as described below. That is to say, the spacer body 91 deforms so that a portion of the spacer body 91 located on the first end 621 side of the liquid containing portion 62 is displaced further in the −Z direction than a portion of the spacer body 91 located on the second end 622 side of the liquid containing portion 62.

The spacer body 91 (FIG. 11) has a center beam 92, a first edge beam 93, a second edge beam 94 (FIG. 12), and first comb teeth 95 and second comb teeth 96, each of which serves as comb teeth.

The center beam 92 extends in a first direction, which is parallel to the direction moving from the first end 621 side toward the second end 622 side of the liquid containing portion 62. In this embodiment, when the liquid container 24 is in the attachment orientation, the first direction is the Y direction. The center beam 92 is a plate-shaped member. When the liquid container 24 is in the attachment orientation, the center beam 92 has a first arrangement face 92*fa* (FIG. 10), which intersects the Z direction, and a second arrangement face 92*fb* (FIG. 11). A portion of the first flow passage 70 is arranged within a recessed portion that is demarcated by the first arrangement face 92*fa*, the first comb teeth 95, and the second comb teeth 96 (FIG. 10). A bottom face of the recessed portion in which a portion of the first flow passage 70 is arranged is formed by the first arrangement face 92*fa*. A portion of the second flow passage 80 is arranged within a recessed portion that is demarcated by the second arrangement face 92*fb*, the first comb teeth 95, and the second comb teeth 96 (FIG. 11). A bottom face of the recessed portion in which a portion of the second flow passage 80 is arranged is formed by the second arrangement face 92*fb*. The center beam 92 is arranged at the center of the spacer member 90 in the X direction. To facilitate understanding, the center beam 92 is cross-hatched in FIG. 13.

The first edge beam 93 and second edge beam 94 extend in the first direction. The first edge beam 93 and second edge beam 94 are arranged at positions on both sides of the center beam 92 in a second direction, which is perpendicular to the first direction (FIG. 13). In this embodiment, when the liquid container 24 is in the attachment orientation, the second direction is the X direction. To facilitate understanding, the first edge beam 93 and second edge beam 94 are single-hatched in FIG. 13.

The first edge beam 93 is a plate-shaped member. The first edge beam 93 is located on the side in the −X direction relative to the center beam 92. The second edge beam 94 is a plate-shaped member. The second edge beam 94 is located on the side in the +X direction relative to the center beam 92. The respective thicknesses of the first edge beam 93 and second edge beam 94 are substantially the same as the thickness of the center beam 92. In another embodiment, the respective thicknesses of the first edge beam 93 and second edge beam 94 may be different from the thickness of the center beam 92.

The first comb teeth 95 and second comb teeth 96 (FIG. 13), each of which serves as comb teeth, connect the center beam 92 to the first edge beam 93 and to the second end 94, respectively. In this embodiment, the first comb teeth 95 connect the center beam 92 to the first edge beam 93. The second comb teeth 96 connect the center beam 92 to the second edge beam 94. In the first comb teeth 95 and second comb teeth 96, each of which serves as comb teeth, a plurality of through holes 952 and 962 are formed that pass through in a third direction, which is perpendicular to the first direction and second direction. In this embodiment, when the liquid container 24 is in the attachment orientation, the third direction is the Z direction, and is a direction parallel to the gravity direction (+Z direction).

The first comb teeth 95 (FIG. 13) have a plurality of demarcation plates 951. The plurality of demarcation plates 951 are members that extend parallel to the X direction and Z direction. The plurality of demarcation plates 951 are arranged at intervals in the Y direction. Each through hole 952 is formed by a gap between two adjoining demarcation plates 951. The plurality of through holes 952 form flow passages through which ink that contains pigment can flow.

The second comb teeth 96 (FIG. 13) have a plurality of demarcation plates 961. The plurality of demarcation plates 961 are members that extend parallel to the X direction and Z direction. The plurality of demarcation plates 961 are arranged at intervals in the Y direction. Each through hole 962 is formed by a gap between two adjoining demarcation plates 961. The plurality of through holes 962 form flow passages through which ink that contains a pigment can flow.

In this embodiment, due to having the center beam 92, first edge beam 93, and second edge beam 94, the spacer body 91 of the spacer member 90 has a rigidity that allows its shape to be maintained in a state where no external force is applied thereto by a user or the like. That is to say, when the liquid container 24 is in the attachment state, it is possible to suppress bending of the spacer member 90 on the side in the −Y direction toward the side in the gravity direction (+Z direction) due to gravity or the like. The spacer body 91 of the spacer member 90 has the first comb teeth 95 and second comb teeth 96, each of which serves as comb teeth, in addition to the aforementioned elements 92, 93, and 94. As a result, the spacer member 90 has a rigidity with which, when an external force is applied to the liquid containing portion 62 by a user or the like, the spacer member 90 can deform following the deformation of the liquid containing portion 62. Since the spacer member 90 can deform following the deformation of the liquid containing portion 62, the spacer member 90 is less likely to break under an external force. Note that the aforementioned rigidity of the spacer member 90 may be provided by appropriately selecting the material of the spacer member 90.

A first support member 97 (FIG. 10) is a member for supporting the first leading end 72 of the first flow passage 70. In this embodiment, the first support member 97 supports the first leading end 72 so that the first introduction port 721 can move relative to the spacer body 91. The first introduction port 721 can move at least in the Z direction when the liquid container 24C is in the attachment orientation.

The first support member 97 has a first arm 971 and a first support portion 972. The first support portion 972 is arranged on the end side of the spacer body 91 in the −Y direction. The first arm 971 has a plate shape. A first end 971*s* of the first arm 971 is connected to the spacer body 91. The first arm 971 can elastically deform so that a second end 971*e* can be displaced in a direction YR1 (FIGS. 15 and 16) having a Z direction component, with the first end 971*s* acting as a fulcrum, due to an external force being applied thereto. The first support portion 972 is connected to the second end 971*e* of the first arm 971. The first support portion 972 is a ring-shaped member having a circumferential portion that is partially open. The first leading end 72 is attached to and detached from the first support portion 972 through this opening.

A second support member 98 (FIG. 12) is a member for supporting the second leading end 82 of the second flow passage 80. In this embodiment, the second support member 98 supports the second leading end 82 so that the second introduction port 821 can move relative to the spacer body 91. The second introduction port 821 can move at least in the Z direction when the liquid container 24C is in the attachment orientation.

The second support member 98 (FIG. 12) has a second arm 981 and a second support portion 982. The second support portion 982 is arranged on the end side of the spacer body 91 in the −Y direction. The second arm 981 has a plate shape. A first end 981*s* of the second arm 981 is connected to the spacer body 91. The second arm 981 can elastically deform so that a second end 981*e* can be displaced in a direction YR2 (FIG. 15) having a Z direction component, with the first end 981*s* acting as a fulcrum, due to an external force being applied thereto. The second support portion 982 is connected to the second end 981*e* of the second arm 981. The second support portion 982 is a ring-shaped member having a circumferential portion that is partially open. The second leading end 82 is attached to and detached from the second support portion 982 through this opening.

The distance between the first support portion 972 and the second support portion 982 in the Z direction is greater than the distance between the first face 627 and the second face 628 of the liquid container 24C in the initial state. With this configuration, when the spacer member 90 is arranged in the liquid containing portion 62, the first support portion 972 abuts against the first face 627, and the second support portion 982 abuts against the second face 628, as shown in FIG. 8. When the liquid container 24C is in the attachment orientation, the first introduction port 721 is located above the second introduction port 821. This positional relationship is maintained regardless of the degree of consumption of the ink (liquid) in the liquid containing portion 62.

It is favorable that the positions at which the liquid flow tubes 70 and 80 are coupled to the spacer member 90 are on the leading end 72, 82 side relative to centers 70P and 80P of the liquid flow tubes 70 and 80, respectively, in the direction parallel to the liquid flow tubes 70 and 80. With this configuration, it is less likely that the positions of the first leading end 72 and second leading end 82 that form the first introduction port 721 and second introduction port 821, respectively, in the liquid containing portion 62 become unstable. As a result, the ink at a desired position in the liquid containing portion 62 can be stably supplied to the liquid ejection apparatus 11 via the liquid flow tubes 70 and 80. In this embodiment, the position at which the first flow passage 70 is coupled to the spacer member 90 is at the first leading end 72 that is supported by the first support portion 972. The position at which the second flow passage 80 is coupled to the spacer member 90 is at the second leading end 82 that is supported by the second support portion 982.

The first introduction port 721 of the first flow passage 70 and the second introduction port 821 of the second flow passage 80 are located on the second end 622 side relative to the center CP of the overall length L1 of the internal space of the liquid containing portion 62 in the Y direction (longitudinal direction of the liquid containing portion 62). In this embodiment, the first introduction port 721 and second introduction port 821 are located slightly closer to the second end 622 than to the center CP. This is for the following reason. When the ink in the liquid containing portion 62 is consumed and the volume of the liquid containing portion 62 decreases, the first face 627 and second face 628 that form the liquid containing portion 62 are most likely to collapse near the center CP in the overall length L1. That is to say, the first face 627 and second face 628 are most likely to abut against the spacer member 90 first near the center CP. If portions of the first face 627 and second face 628 near the center CP collapse earlier than the other portions, the flow of the ink in the liquid containing portion 62 may be obstructed by the collapsed portions. If the ink flow is obstructed, for example, the ink that is present on the first end 621 side relative to the collapsed portions is unlikely to reach the first introduction port 721 and second introduction port 821. Accordingly, the first introduction port 721 and second introduction port 821 are located slightly closer to the second end 622 than to the center CP of the overall length L1. Thus, a space can be readily formed around the first introduction port 721 and second introduction port 821, even if the first face 627 and second face 628 collapse first near the center CP. By thus allowing the ink to flow through the formed space, the ink that is present on the first end 621 side relative to the center CP can flow toward the first introduction port 721 and second introduction port 821.

In the attachment orientation, the second introduction port 821 is located below the first introduction port 721. Thus, the concentration of the precipitating component in the ink that flows into the second introduction port 821 is higher than that in the ink that flows into the first introduction port 721. High-concentration ink usually has a high viscosity. Accordingly, it is favorable to employ the following configuration to avoid unevenness between the amount (e.g. amount per unit time) of low-concentration ink that flows through the first flow passage 70 and reaches the liquid leading portion 61 and the amount (e.g. amount per unit time) of high-concentration ink that flows through the second flow passage 80 and reaches the liquid leading portion 61. For example, the resistance in the passage from the first introduction port 721 of the first flow passage 70 up to the liquid leading portion 61 (first resistance) is set greater than the resistance in the passage from the second introduction port 821 of the second flow passage 80 up to the liquid leading portion 61 (second resistance). To set the first resistance to be greater than the second resistance, for example, the flow passage length from the first introduction port 721 of the first flow passage 70 up to the liquid leading portion 61 (first flow passage length) need only be set longer than the flow passage length from the second introduction port 821 of the second flow passage 80 up to the liquid leading portion 61 (second flow passage length). Otherwise, for example, the flow passage diameter of the first flow passage 70 may be set smaller than the flow passage diameter of the second flow passage 80. Also, for example, the inner diameter of the portion supported by the first support portion 972 (the first leading end 72 in this embodiment) may be set smaller than the inner diameter of the portion supported by the second support portion 982 (the second leading end 82 in this embodiment), by setting the inner diameter of the first support portion 972 to be smaller than the inner diameter of the second support portion 982. Two or more of the relationship regarding the flow passage length, the relationship regarding the flow passage diameter, and the relationship regarding the inner diameter of the first and second support portion 972 and 982 may be combined. In this embodiment, the first introduction port 721 is arranged on the second end 622 side relative to the second introduction port 821, thereby making the first flow passage length longer than the second flow passage length (FIG. 8).

Figure 17:
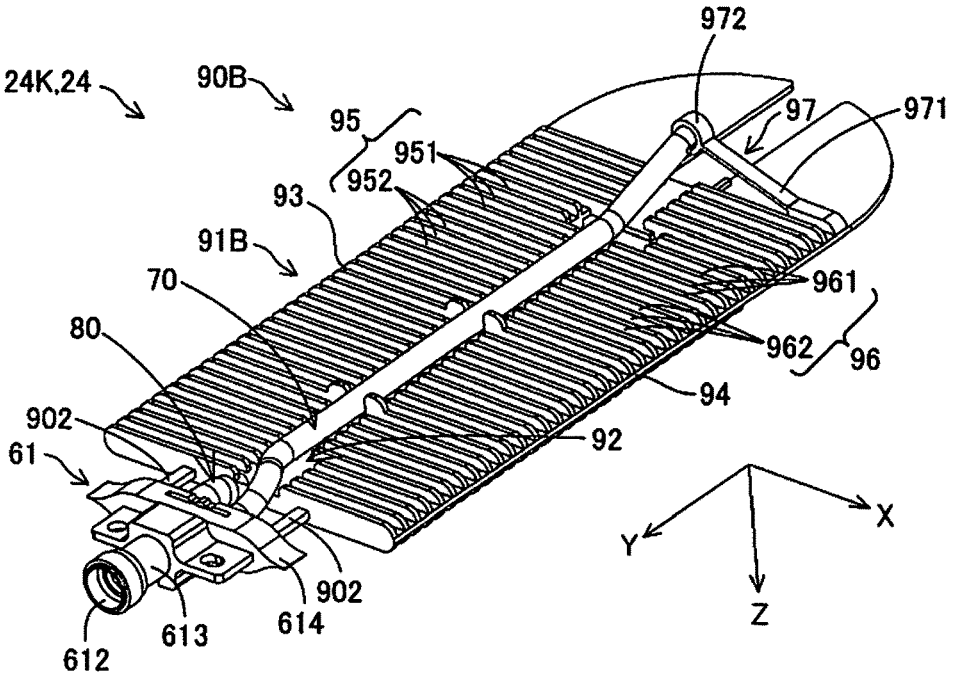
FIG. 17 is a perspective view showing an internal configuration of the liquid leading portion and the liquid containing portion.

FIG. 17 is a perspective view showing the internal configuration of the liquid leading portion 61 and liquid containing portion 62 that are provided in the liquid container 24K. Differences between the liquid container 24C and liquid container 24K lie in that the length of the liquid containing portion 62 (not shown) of the liquid container 24K in the X direction is longer than the length of the liquid containing portion 62 of the liquid container 24C in the X direction, and that the length of a spacer body 91B of a spacer member 90B is correspondingly longer than the that of the spacer body 91 (FIG. 9). Since the other elements are the same between the liquid container 24K and the liquid container 24C, like elements will be assigned like signs, and descriptions thereof will be omitted.

Figure 18:
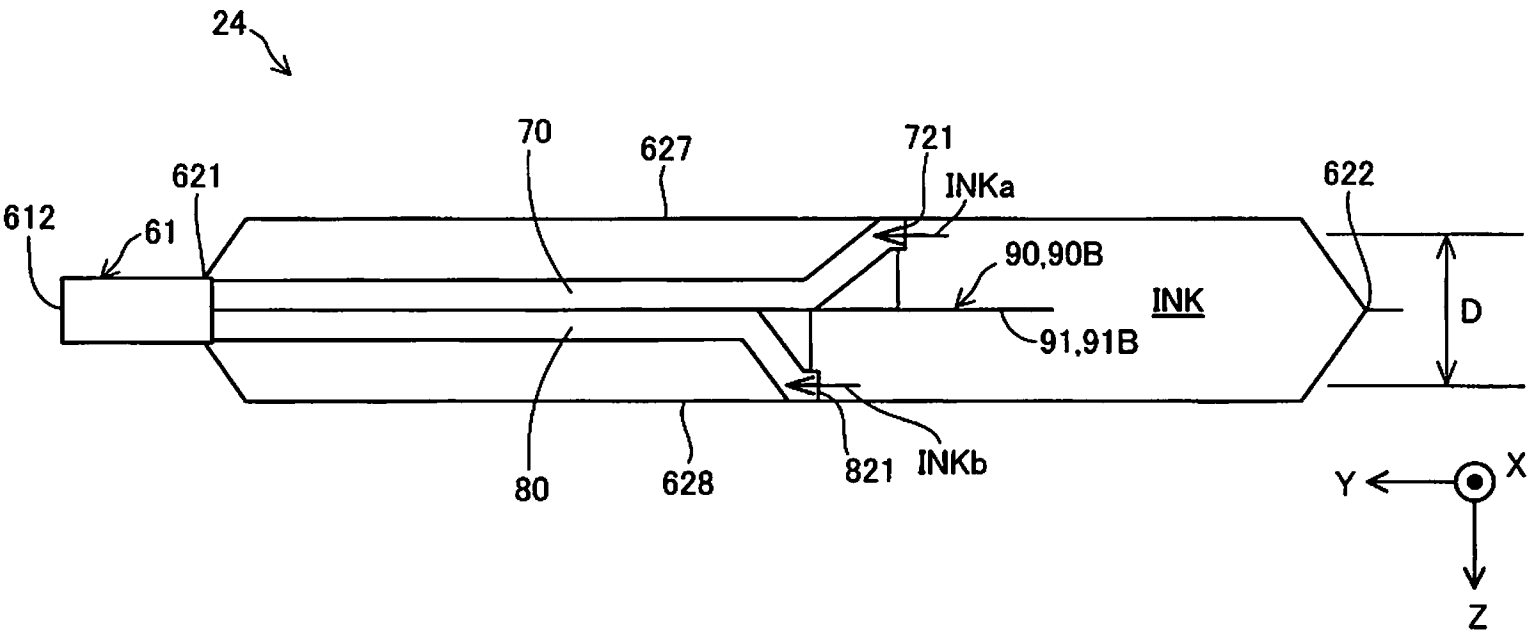
FIG. 18 is a schematic view showing an initial state of the liquid container.
Figure 19:
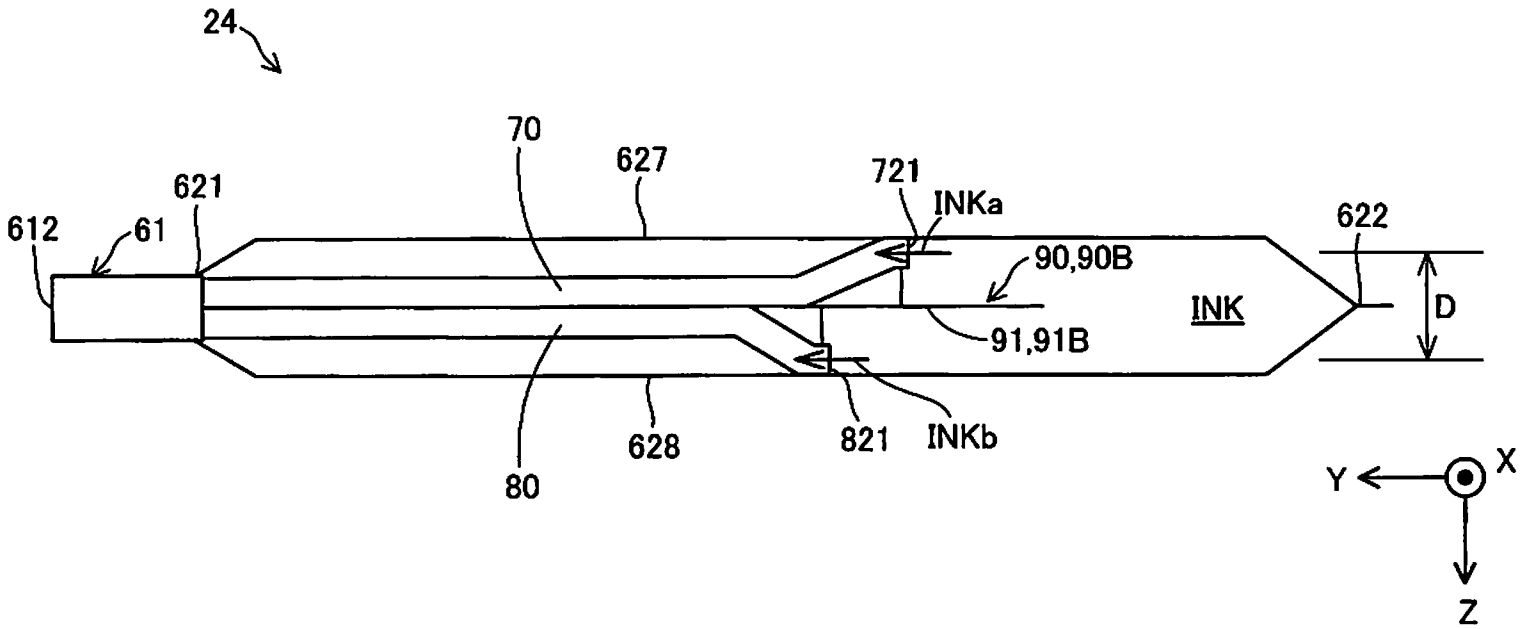
FIG. 19 is a schematic view showing a state of the liquid container when a certain amount of ink in the liquid containing portion has been consumed.
Figure 20:
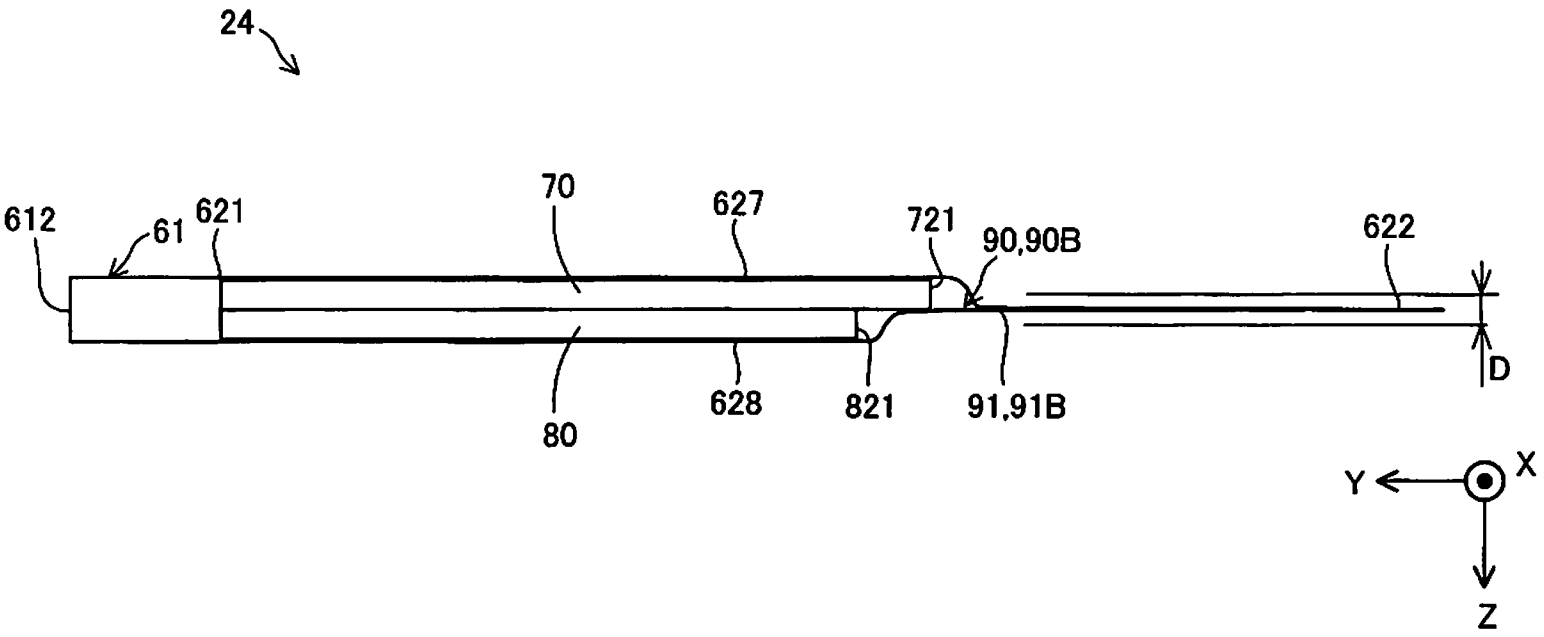
FIG. 20 is a schematic view showing a state of the liquid container when the ink cannot be supplied to the liquid ejection apparatus.

A-3. Regarding Process of Consumption of Liquid in Liquid Container:

FIG. 18 is a schematic view showing the initial state of the liquid container 24. FIG. 19 is a schematic view showing a state of the liquid container 24 when a certain amount of ink in the liquid containing portion 62 has been consumed. FIG. 20 is a schematic view showing a state of the liquid container 24 when the ink in the liquid containing portion 62 has been consumed and cannot be supplied to the liquid ejection apparatus.

The distance between the first introduction port 721 and second introduction port 821 will be denoted as the distance D. The distance D is the distance in the Z direction (direction parallel to the gravity direction) in the attachment orientation. The distance D is the distance between the center of the first introduction port 721 and the center of the second introduction port 821.

As the ink in the liquid containing portion 62 is supplied to the liquid ejection apparatus 11 and is thus consumed, the volume of the liquid containing portion 62 decreases. That is to say, as the ink is consumed, the first face 627 and second face 628 of the liquid containing portion 62 are displaced in the directions approaching each other. In this embodiment, as the ink in the liquid containing portion 62 is consumed, the first face 627 is displaced in the +Z direction to approach the spacer body 91/91B, and the second face 628 is displaced in the −Z direction to approach the spacer body 91/91B. Due to the first face 627 being displaced, the first introduction port 721 is displaced as a result of being directly or indirectly pressed in the +Z direction by the first face 627. Due to the second face 628 being displaced, the second introduction port 821 is displaced as a result of being directly or indirectly pressed in the −Z direction by the second face 628. Accordingly, the distance D between the first introduction port 721 and the second introduction port 821 gradually decreases as the volume of the liquid containing portion 62 decreases.

Most of the pigment particles, which are a precipitating component in ink INK in the liquid containing portion 62, move in the gravity direction (+Z direction) under their own weight. Accordingly, the ink concentration in the liquid containing portion 62 tends to be higher on the second face 628 side than on the first face 627 side. In this embodiment, high-concentration ink INKb that contains many pigment particles is suctioned from the second introduction port 821 into the second flow passage 80, and reaches the liquid leading portion 61. Low-concentration ink INKa that contains less pigment particles than in the ink INKb is suctioned from the first introduction port 721 into the first flow passage 70, and reaches the liquid leading portion 61. The high-concentration ink INKb and low-concentration ink INKa that have reached the liquid leading portion 61 merge in the liquid leading portion 61, and are then supplied to the liquid ejection apparatus 11.

When the liquid container 24 is in a state shown in FIG. 20, the first face 627 and second face 628 that form the liquid containing portion 62 are closely attached to the outer surface of the spacer body 91/91B to close the through holes 952 and 962 (FIG. 13). Thus, passages for the ink in the through holes 952 and 962 to reach the first introduction port 721 and second introduction port 821 are cut off, and the ink can be retained in the through holes 952 and 962. Regarding the ink that is present around the first introduction port 721 and second introduction port 821, high-concentration ink has a high viscosity, and is not easily suctioned into the first introduction port 721 and second introduction port 821. Accordingly, ink that is retained in the liquid containing portion 62 tends to be high-concentration ink that contains many pigment particles. This high-concentration ink is retained in the through holes (liquid-retaining spaces) 952 and 962, thereby suppressing the supply of this ink to the liquid ejection apparatus 11.

A-4. Effects:

According to the first embodiment, the liquid container 24 has the spacer member 90/90B (FIGS. 9 and 17). This configuration makes it possible to retain, in the liquid containing portion 62, high-concentration liquid (ink) that contains a large amount of precipitating component (pigment particles in this embodiment) remaining in the liquid containing portion 62. Due to the liquid flow tubes 70 and 80 being coupled to the spacer member 90/90B that is coupled to the liquid leading portion 61, the positions of the liquid flow tubes 70 and 80 in the liquid containing portion 62 are less likely to be unstable. Thus, liquid at a desired position in the liquid containing portion 62 can be supplied to the liquid ejection apparatus 11 via the liquid flow tubes 70 and 80. In addition, since high-concentration liquid can be retained in the liquid containing portion 62, the concentration in the liquid supplied to the liquid ejection apparatus 11 is less likely to be uneven.

According to the first embodiment, when the liquid container 24 is in the attachment orientation, the first introduction port 721 is located above the second introduction port 821 (FIGS. 18 and 19). With this configuration, the low-concentration liquid and the high-concentration liquid can be caused to flow toward the liquid leading portion 61 using the first flow passage 70 and the second flow passage 80, respectively. As a result, liquid that is a mixture of the low-concentration liquid and high-concentration liquid is led from the liquid leading portion 61 toward the liquid ejection apparatus 11. Accordingly, liquid with a more stable concentration can be supplied to the liquid ejection apparatus 11.

According to the first embodiment, the distance D between the first introduction port 721 and second introduction port 821 gradually decreases as the liquid in the liquid containing portion 62 is consumed and the volume of the liquid containing portion 62 decreases (FIGS. 18 to 20). Thus, the concentration in the liquid introduced from the first introduction port 721 and the concentration in the liquid introduced from the second introduction port 821 is less likely to differ greatly. That is to say, the concentration in the liquid supplied to the liquid ejection apparatus 11 is hardly affected by the degree of precipitation of pigment particles, and is even less likely to be uneven. Since the first introduction port 721 and second introduction port 821 are movable relative to the spacer body 91/91B, common liquid flow tubes 70 and 80 can be used for liquid containers 24 that have liquid containing portions 62 with different sizes. For example, by manufacturing the liquid flow tubes 70 and 80 so as to fit a liquid containing portion 62 whose length in the up-down direction (Z direction) is longest, the manufactured liquid flow tubes 70 and 80 can also be used for the other liquid containing portions 62.

According to the first embodiment, in the attachment orientation, the through holes 952 and 962 pass through the spacer member 90/90B in a direction (Z direction) parallel to the gravity direction (+Z direction) (FIG. 13). As a result, liquid that is present above and below the spacer member 90/90B in the liquid containing portion 62 can flow through the plurality of through holes 952 and 962. As a result, the concentration distribution in the liquid in the liquid containing portion 62 is less likely to be uneven.

B. Second Embodiment

Figure 21:
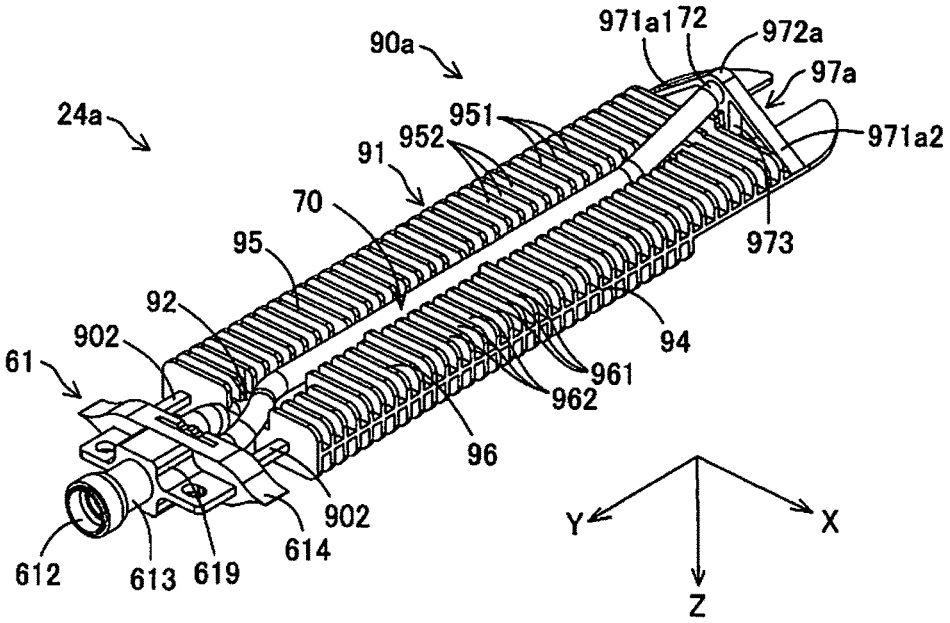
FIG. 21 is a first perspective view of the liquid leading portion and a spacer member.
Figure 22:
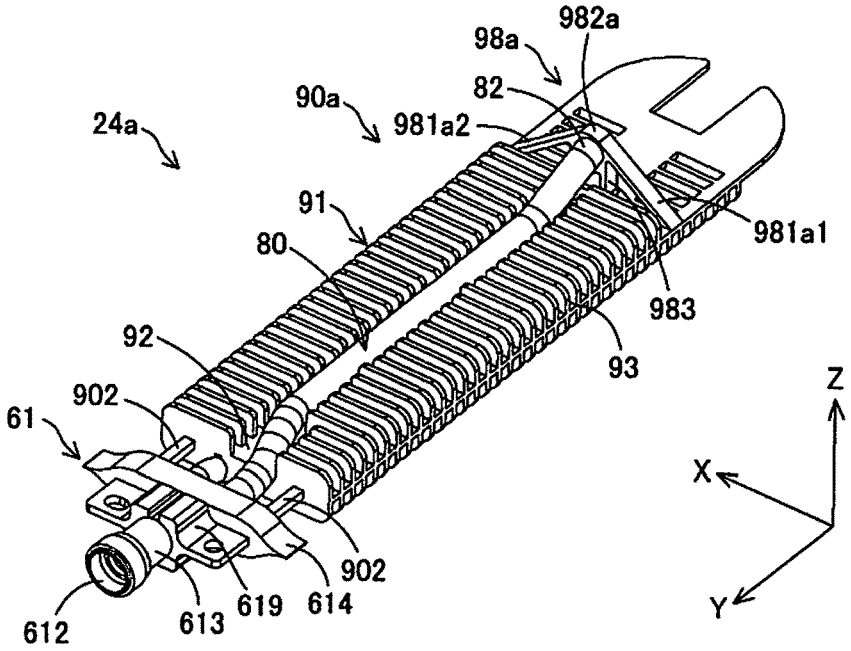
FIG. 22 is a second perspective view of the liquid leading portion and the spacer member.
Figure 23:
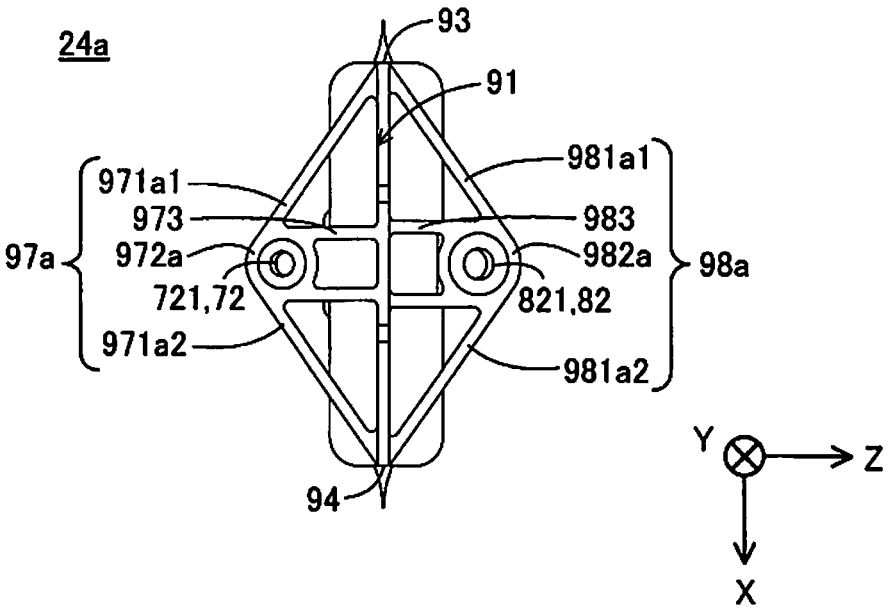
FIG. 23 is equivalent to the diagram in FIG. 21 as shown from the side in the −Y direction.

FIG. 21 is a first perspective view of the liquid leading portion 61 and a spacer member 90*a* that are provided in a liquid container 24*a* according to the second embodiment. FIG. 22 is a second perspective view of the liquid leading portion 61 and a spacer member 90*a* that are provided in a liquid container 24*a*. FIG. 23 is equivalent to the diagram in FIG. 21 as shown from the side in the −Y direction. Differences between the liquid container 24 (FIG. 9) according to the first embodiment and the liquid container 24*a* according to the second embodiment lie in the configuration of a first support member 97*a* and a second support member 98*a*. Since the other elements are the same between the liquid container 24 according to the first embodiment and the liquid container 24*a* according to the second embodiment, like elements will be assigned like signs, and descriptions thereof will be omitted. Note that, although not shown in the diagrams, the liquid container 24*a* according to the second embodiment also has the case 40 (FIG. 6). The liquid container 24*a* is removably attached to the liquid ejection apparatus 11 (FIG. 1) and supplies ink to the liquid ejection apparatus 11. The liquid container 24*a* according to the second embodiment may be employed as a liquid container for containing color ink and a liquid container for containing black ink.

The first support member 97*a* supports the first leading end 72. By being supported by the first support member 97*a*, the position of the first leading end 72 relative to the spacer member 90*a* is fixed regardless of a change in the volume of the liquid containing portion 62.

The first support member 97*a* (FIG. 23) includes a first fixed arm 971*a*1, a second fixed arm 971*a*2, a third fixed arm 973, and a first support portion 972*a*. A first end of the first fixed arm 971*a*1 is connected to the first edge beam 93 of the spacer body 91. A first end of the second fixed arm 971*a*2 is connected to the second edge beam 94 of the spacer body 91. A first end of the third fixed arm 973 is connected to a portion of the spacer body 91 that is substantially at the center thereof in the X direction, and extends in the anti-gravity direction (−Z direction). The first support portion 972*a* is connected to a second end of the first fixed arm 971*a*1, a second end of the second fixed arm 971*a*2, and a second end of the third fixed arm 973. The first support portion 972*a* has a ring shape. As a result of the first leading end 72 being inserted into an opening formed by the first support portion 972*a*, the first flow passage 70 serving as the liquid flow tube is coupled to the spacer member 90. In addition, as a result of the first leading end 72 being inserted into the opening formed by the first support portion 972*a*, the first leading end 72 is fastened by the first support portion 972*a* in a direction in which its diameter decreases. Thus, the first leading end 72 is fixed to the spacer member 90*a* by the first support portion 972*a*. Note that the first leading end 72 may be fixed to the first support portion 972*a* by means of welding or the like.

Due to the first support member 97*a* having the first fixed arm 971*a*1, second fixed arm 971*a*2, and third fixed arm 973, the position of the first support portion 972*a* relative to the spacer body 91 does not change regardless of a change in the volume of the liquid containing portion 62. That is to say, the first support portion 972*a* is not displaced even when pressed against a face (first face 627 in this embodiment) that forms the liquid containing portion 62. As a result, the position of the first leading end 72 relative to the spacer member 90*a* is fixed regardless of a change in the volume of the liquid containing portion 62.

The position of the first leading end 72 relative to the spacer member 90*a* is fixed regardless of a change in the volume of the liquid containing portion 62, by being supported by the first support member 97*a*.

The second support member 98*a* (FIG. 23) has the same configuration as that of the first support member 97*a*. That is to say, the second support member 98*a* includes a first fixed arm 981*a*1, a second fixed arm 981*a*2, a third fixed arm 983, and a second support portion 982*a*. A first end of the first fixed arm 981*a*1 is connected to the first edge beam 93 of the spacer body 91. A first end of the second fixed arm 981*a*2 is connected to the second edge beam 94 of the spacer body 91. A first end of the third fixed arm 983 is connected to a portion of the spacer body 91 that is substantially at the center thereof in the X direction, and extends in the gravity direction (+Z direction). The second support portion 982*a* is connected to a second end of the first fixed arm 981*a*1, a second end of the second fixed arm 981*a*2, and a second end of the third fixed arm 983. The second support portion 982*a* has a ring shape. As a result of the second leading end 82 being inserted into an opening formed by the second support portion 982*a*, the second flow passage 80 serving as the liquid flow tube is coupled to the spacer member 90. In addition, as a result of the second leading end 82 being inserted into the opening formed by the second support portion 982*a*, the second leading end 82 is fastened in a direction in which its diameter decreases. Thus, the second leading end 82 is fixed to the spacer member 90*a* by the second support portion 982*a*. Note that the second leading end 82 may be fixed to the second support portion 982*a* by means of welding or the like.

Due to the second support member 98*a* having the first fixed arm 981*a*1, second fixed arm 981*a*2, and third fixed arm 983, the position of the second support portion 982*a* relative to the spacer member 91 does not change regardless of a change in the volume of the liquid containing portion 62. That is to say, the second support portion 982*a* is not displaced even when pressed against a face (second face 628 in this embodiment) that forms the liquid containing portion 62. As a result, the position of the second leading end 82 relative to the spacer member 90*a* is fixed regardless of a change in the volume of the liquid containing portion 62.

The second embodiment also achieves the same effects as those of the first embodiment due to having the same configuration as that of the first embodiment. For example, the liquid container 24*a* has the spacer member 90*a* (FIG. 21). This configuration makes it possible to retain, in the liquid containing portion 62, high-concentration liquid (ink) that contains a large amount of precipitating component (pigment particles in this embodiment) remaining in the liquid containing portion 62. Due to the liquid flow tubes 70 and 80 being coupled to the spacer member 90*a* that is coupled to the liquid leading portion 61 by the coupling member 902, the positions of the liquid flow tubes 70 and 80 in the liquid containing portion 62 are less likely to be unstable. Thus, liquid at a desired position in the liquid containing portion 62 can be supplied to the liquid ejection apparatus 11 via the liquid flow tubes 70 and 80. In addition, since the high-concentration liquid can be retained in the liquid containing portion 62, the concentration in the liquid supplied to the liquid ejection apparatus 11 is less likely to be uneven.

According to the second embodiment, the positions of the first leading end 72 and second leading end 82 relative to the spacer member 90*a* are fixed regardless of a change in the volume of the liquid containing portion 62. As a result, even if the volume of the liquid containing portion 62 has changed and the shape of the liquid containing portion 62 has also changed in various manners, the positions of the first leading end 72 and second leading end 82 relative to the spacer member 90*a* can be maintained. Thus, the liquid at a desired position in the liquid containing portion 62 can be more stably supplied to the liquid ejection apparatus 11 via the first flow passage 70 and second flow passage 80.

According to the second embodiment, the first leading end 72 and second leading end 82 are fixed to the spacer member 90*a*. As a result, even if the liquid container 24*a* receives an impact due to, for example, the liquid container 24*a* falling at the time of transportation, the first leading end 72 and second leading end 82 are less likely to come off of the spacer member 90*a*.

C. Third Embodiment

Figure 24:
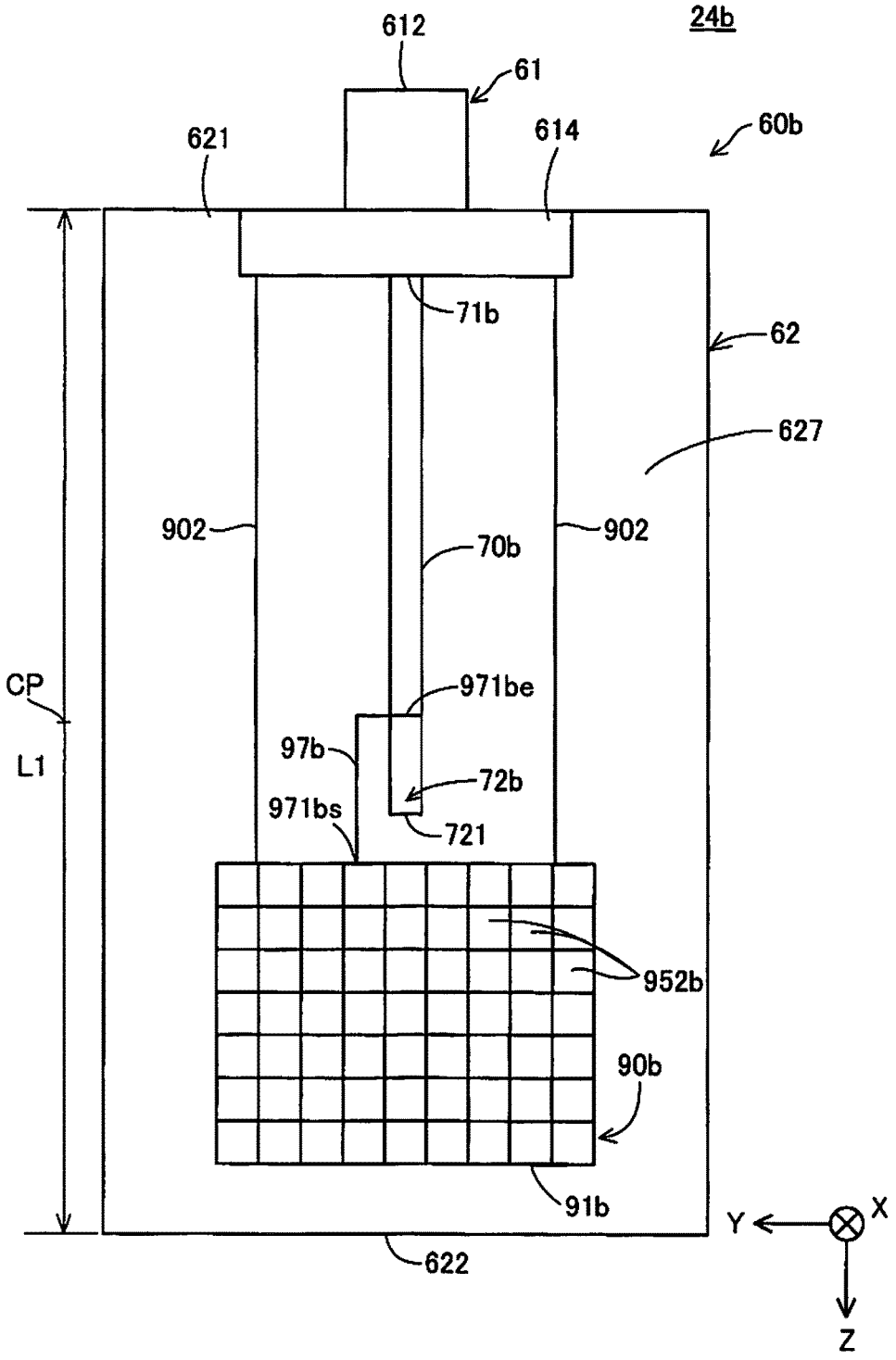
FIG. 24 is a schematic diagram illustrating a liquid container according to a third embodiment.

FIG. 24 is a schematic diagram illustrating a liquid container 24*b* according to the third embodiment. Differences between the liquid container 24 according to the first embodiment and the liquid container 24*b* according to the third embodiment lie in the attachment orientation of the liquid container 24*b*, the configuration of a liquid flow tube 70*b*, and the configuration of a spacer member 90*b*. Since other elements are the same as those of the liquid container 24 according to the first embodiment, like elements will be assigned like signs, and descriptions thereof will be omitted. The liquid containing portion 62 of a container body 60*b* of the liquid container 24*b* is accommodated in the case 40 (FIG. 6), similar to the first embodiment. In the liquid ejection apparatus 11 to which the liquid container 24*b* is removably attached, the liquid introduction tube 32 is arranged so as to extend in the gravity direction (+Z direction), from the base end toward the leading end that is inserted into the opening 612. In the third embodiment, the direction in which the liquid container 24*b* is attached to the liquid ejection apparatus 11 is the −Z direction, and the removing direction is the +Z direction.

A liquid flow tube 70*b* is a tube. The liquid flow tube 70*b* has a base end 71*b*, which is connected to the liquid leading portion 61, and extends from the liquid leading portion 61 toward the second end 622 within the liquid containing portion 62. When the liquid container 24*b* is in the attachment orientation, the liquid flow tube 70*b* is configured to extend from the liquid leading portion 61 to a side in the gravity direction (+Z direction) within the liquid containing portion 62. That is to say, a leading end 72*b*, at which the introduction port 721 is formed, is located on the side in the gravity direction relative to the base end 71*b*. In this embodiment, the liquid flow tube 70*b* extends from the base end 71*b* in a direction parallel to the gravity direction.

The spacer member 90*b* has a spacer body 91*b*, which forms through holes 952*b* that serve as liquid-retaining spaces for retaining ink (liquid) in the liquid containing portion 62, and a support member 97*b* for connecting the spacer body 91*b* to the liquid flow tube 70*b*. The spacer member 90*b* is coupled to the liquid leading portion 61 through the connecting member 902. The position of the spacer member 90*b* relative to the liquid leading portion 61 is fixed by the coupling member 902. When the liquid container 24*b* is in the attachment orientation, the spacer body 91*b* has a portion that is located below (on the side in the +Z direction) the liquid flow tube 70*b*. In this embodiment, the entire spacer body 91*b* is located below the liquid flow tube 70*b*. A first end 971*bs* of the support member 97*b* is connected to the spacer body 91*b*, and a second end 971*be* holds the liquid flow tube 70*b*. The second end 971*be* has a ring shape. The liquid flow tube 70*b* is inserted in an opening the forms this ring shape. Note that the second end 971*be* may be fixed to the liquid flow tube 70*b* by means of welding or the like.

The spacer body 91*b* has a substantially rectangular-parallelepiped shape. The spacer body 91*b* has a rectangular-parallelepiped shape in which lattices are formed in the X direction, Y direction, and Z direction. The spacer body 91*b* has a plurality of through holes 952*b* that pass therethrough in the X direction, Y direction, and Z direction. These through holes 952 are formed within the lattices in the X direction, Y direction, and Z direction. When the liquid in the liquid containing portion 62 has decreased to some extent, the first face 627 and second face (not shown) that form the liquid containing portion 62 is closely attached to the outer surface of the spacer body 91*b* to close the through holes 952*b*. Thus, passages for the ink in the through holes 952*b* to reach the first introduction port 721 and second introduction port 821 are cut off, and the ink can be retained in the through holes 952*b*.

It is favorable that the position at which the liquid flow tube 70 is connected to the spacer member 90*b* (i.e. the position of the second end 971*be*) is located on the leading end 72*b* side relative to the center of the liquid flow tube 70*b* in the direction parallel to the liquid flow tube 70*b* (Z direction). With this configuration, the position of the leading end 72*b* that forms the introduction port 721 in the liquid containing portion 62 is less likely to be unstable. As a result, the ink at a desired position in the liquid containing portion 62 can be stably supplied to the liquid ejection apparatus 11 via the liquid flow tubes 70*b*. Similar to the first embodiment, the introduction port 721 is located on the second end 622 side relative to the center CP of the overall length L1 of the internal space of the liquid containing portion 62 in the Z direction (longitudinal direction of the liquid containing portion 62). In this embodiment, the introduction port 721 is located slightly closer to the second end 622 than to the center CP, similar to the first embodiment.

The third embodiment also achieves the same effects as those of the first embodiment due to having the same configuration as that of the first embodiment. For example, the liquid container 24*b* has the spacer member 90*b*. This configuration makes it possible to retain, in the liquid containing portion 62, high-concentration liquid (ink) that contains a large amount of precipitating component (pigment particles in this embodiment) remaining in the liquid containing portion 62. Due to the liquid flow tube 70*b* being coupled to the spacer member 90*b* that is coupled to the liquid leading portion 61 by the coupling member 902, the position of the liquid flow tube 70*b* in the liquid containing portion 62 is less likely to be unstable. Thus, liquid at a desired position in the liquid containing portion 62 can be supplied to the liquid ejection apparatus 11 via the liquid flow tube 70*b*. In addition, high-concentration liquid can be retained in the liquid containing portion 62. Accordingly, the concentration in the liquid supplied to the liquid ejection apparatus 11 is less likely to be uneven.

According to the third embodiment, when the liquid container 24*b* is in the attachment orientation, the spacer body 91*b* is located below the liquid flow tube 70*b*. Thus, higher-concentration liquid in the liquid containing portion 62 can be retained in the through holes 952, which serve as the liquid-retaining spaces, in the spacer body 91*b*.

D. Variation of Third Embodiment

Figure 25:
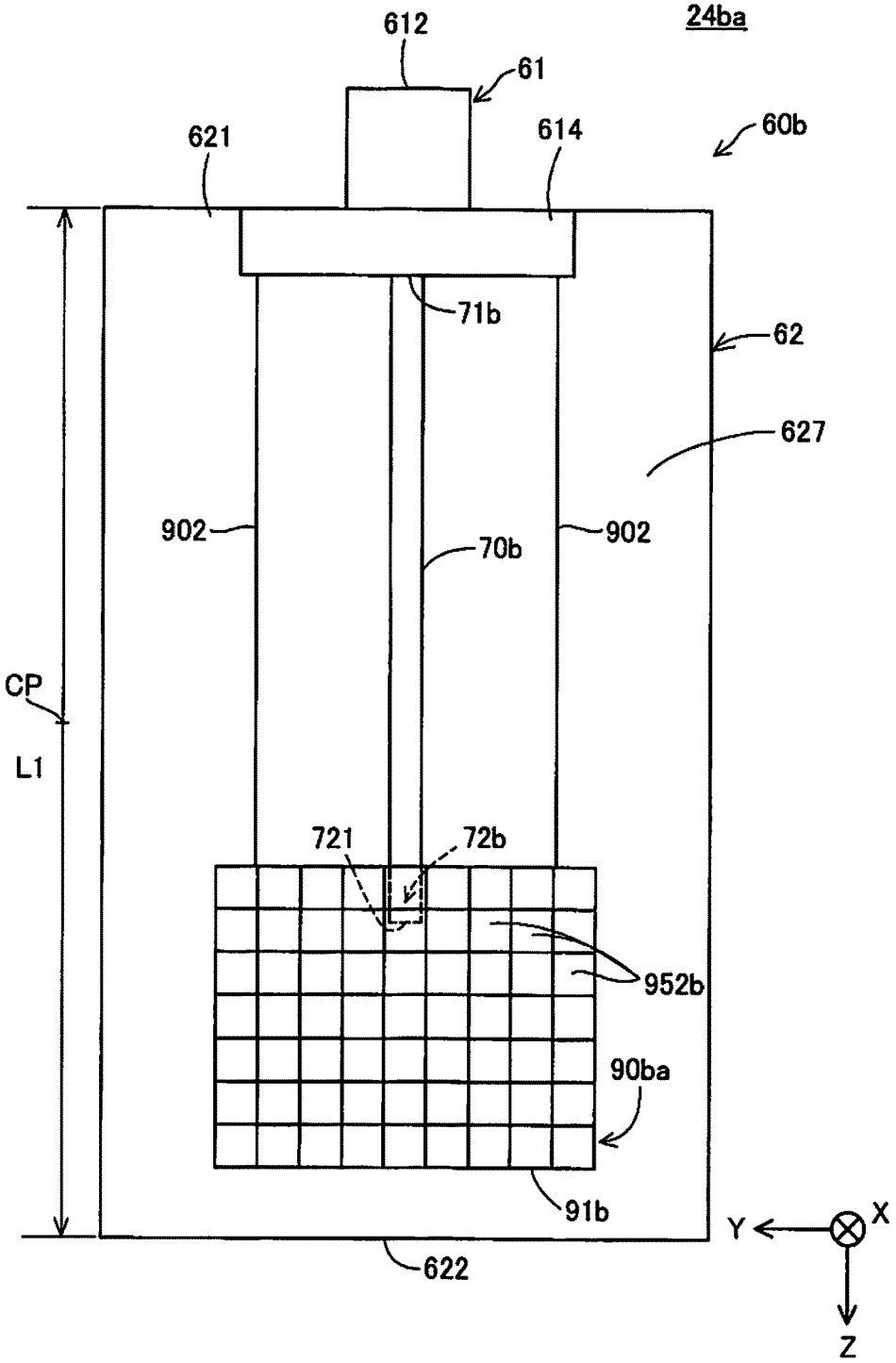
FIG. 25 is a schematic diagram illustrating a liquid container that is a variation.

FIG. 25 is a schematic diagram illustrating a liquid container 24*ba*, which is a variation of the third embodiment. In the liquid container 24*b* according to the third embodiment, the liquid flow tube 70*b* is connected to the spacer body 91*b* by the support member 97*b*. However, in this variation, the liquid flow tube 70*b* is directly connected to the spacer body 91*b*, thereby being coupled thereto. Specifically, the leading end 72*b* is arranged within the spacer body 91*b*, and is fixed to the spacer body 91*b* by means of welding or the like. A spacer member 90*ba* of the liquid container 24*ba* does not have the support member 97*b*.

With this configuration as well, the same effects as those of the liquid container 24*b* according to the third embodiment are achieved. In addition, the leading end 72*b* is fixed to the spacer member 90*ba* by means of welding or the like. As a result, even if the liquid container 24*ba* receives an impact due to, for example, the liquid container falling at the time of transportation, the leading end 72*b* is less likely to come off of the spacer member 90*ba*.

E. Variation of Liquid Leading Portion and Spacer Member

Figure 26:
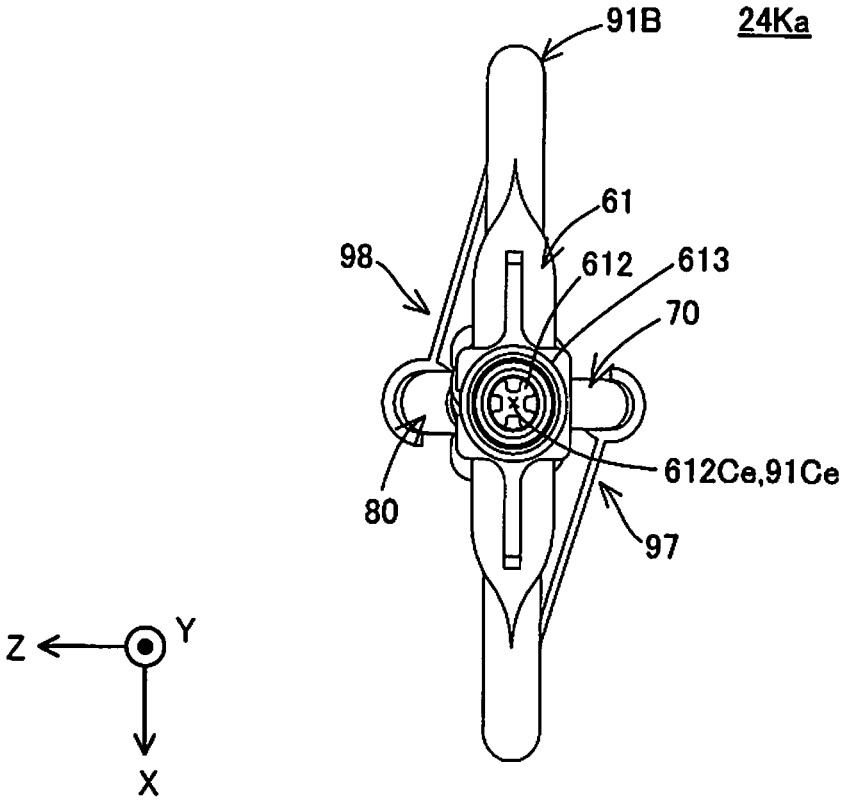
FIG. 26 is a diagram illustrating a liquid container.

A favorable relationship between the liquid leading portion 61 and the spacer members 90, 90*a*, 90*b*, 90*ba*, and 90B in the respective embodiments will be described, taking a liquid container 24Ka for containing black ink as an example. FIG. 26 is a diagram illustrating the liquid container 24Ka. FIG. 26 corresponds to FIG. 14. Although FIG. 26 illustrates the liquid container 24Ka for containing black ink, the other liquid containers 24C to 24Y may also have the same relationship.

In the liquid container 24Ka, it is favorable that, in at least one of the three directions, namely the X direction, Y direction, and Z direction, the size of the spacer body 91B is smaller than the size of the liquid leading portion 61. With this configuration, it is possible to suppress an increase in the size of the liquid containing portion 62 after the liquid in the liquid containing portion 62 has been consumed.

In this variation, the size of the spacer body 91B in the Z direction is smaller than the size of the liquid leading portion 61. This configuration can suppress an increase in the size of the liquid containing portion 62 in the Z direction. The Z direction is the thickness direction of the space body 91*b*, which is flat. Accordingly, the shape of the liquid containing portion 62 can be made flat after the liquid in the liquid containing portion 62 has been consumed. Thus, pointed portions and projecting portions of the liquid containing portion 62 can be reduced. As a result, the liquid containing portion 62 is less likely to be damaged or broken. Note that, in another variation, the size of the spacer body 91B in the X direction and Y direction may be smaller than the size of the liquid leading portion 61.

It is also favorable that the spacer members 90, 90*a*, 90*b*, 90*ba*, and 906 are smaller than the liquid containing portion 62 in two directions (e.g. X direction and Y direction) that are perpendicular to the direction in which the liquid containing portion 62 contracts as the liquid is consumed (e.g. Z direction). Thus, an increase in the size of the liquid containing portion 62 can be further suppressed.

It is also favorable that, when the liquid container 24*a* is viewed from the opening 612 side (from the side in the attaching direction), a center axis 612Ce of the cylindrical leading end connecting portion 613 overlaps a center 91Ce of the spacer body 91B in the thickness direction (e.g. Z direction) and the width direction (e.g. X direction). With this configuration, as the liquid in the liquid containing portion 62 is consumed, the liquid containing portion 62 can be caused to collapse further in a symmetrical manner in the left-right direction and up-down direction when viewed from the opening 612 side. As a result, the user is less likely to feel that something is amiss about the way the liquid containing portion 62 collapses.

F. Modifications

Note that this invention is not limited to the above examples and embodiments, and may be implemented in various modes without departing from the gist of the invention. For example, the following modifications are also possible.

F-1. First Modification:

In the above embodiments and variations, the liquid containers 24, 24*a*, 24*b*, 24*b* a, and 24Ka each have the case 40, but the case 40 may not be employed.

F-2. Second Modification:

The liquid containers 24 and 24*a* according to the first and second embodiments are each provided with two liquid flow tubes 70 and 80 (e.g. FIG. 8). However, the number of liquid flow tubes may be one, or may be three or more. The liquid container 24*b* according to the third embodiment is provided with one liquid flow tube 70*b* (FIG. 24). However, the number of liquid flow tubes may be two or more. In the case of providing two liquid flow tubes 70*b*, it is favorable that, when the liquid container 24*b* is in the attachment orientation, the introduction port 721 of one of the liquid flow tubes 70*b* is located above the introduction port 721 of the other liquid flow tube 70*b*. With this configuration, the low-concentration liquid and the high-concentration liquid can be caused to flow toward the liquid leading portion 61 using one of the liquid flow tubes 70*b* and the other liquid flow tube 70*b*, respectively. As a result, liquid that is a mixture of the low-concentration liquid and high-concentration liquid is led from the liquid leading portion 61 toward the liquid ejection apparatus 11. Accordingly, liquid with a more stable concentration can be supplied to the liquid ejection apparatus 11.

F-3. Third Modification:

In the first and second embodiments, the first flow passage 70 merges with the second flow passage 80 in the liquid leading portion 61. However, the invention is not limited thereto. A configuration may also be employed in which the liquid flow tube is branched on the leading end side, and the branches merge on the base end side close to the liquid leading portion 61.

F-4. Fourth Modification:

The invention is applicable not only to an inkjet printer and a liquid container for supplying ink to the inkjet printer, but also to any liquid ejection apparatus that ejects liquid other than ink and having a precipitating component, and a liquid container for supplying ink thereto. For example, the invention is applicable to various liquid ejection apparatuses as listed below and liquid containers thereof:

(1) image recording apparatuses such as a facsimile apparatus;

(2) color material ejection apparatuses used to manufacture color filters for image display apparatuses such as a liquid crystal display;

(3) electrode material ejection apparatuses used to form electrodes for organic EL (Electro Luminescence) displays, field emission displays (FED), or the like;

(4) liquid ejection apparatuses that eject liquid containing biological organic matter used to manufacture biochips:

(5) sample ejection apparatuses serving as precision pipettes;

(6) lubricating oil ejection apparatuses;

(7) resin solution ejection apparatuses;

(8) liquid ejection apparatuses that eject lubricating oil pinpoint to precision machines such as a watch and a camera;

(9) liquid ejection apparatuses that eject a transparent resin solution such as a UV-cured resin solution onto substrates in order to form micro-hemispherical lenses (optical lenses) used in optical communication elements and the like;

(10) liquid ejection apparatuses that eject acid or alkaline etchant in order to etch substrates and the like; and

(11) liquid ejection apparatuses including liquid ejection heads for discharging a very small amount of any other kind of droplet.

Note that "droplet" refers to a state of the liquid discharged from a liquid ejection apparatus, and includes droplets having a granular shape, a tear-drop shape, and a shape having a thread-like trailing end. Furthermore, the "liquid" mentioned here need only be any kind of material that can be ejected by a liquid ejection apparatus. For example, the "liquid" need only be a material in a state where a substance is in a liquid phase, and a liquid material having a high or low viscosity, sol, gel water, and other liquid materials such as an inorganic solvent, organic solvent, solution, liquid resin, and liquid metal (metallic melt) are also included as a "liquid". The "liquid" is not limited to being a single-state substance, and also includes particles of a functional material made from solid matter, such as pigment or metal particles, that are dissolved, dispersed, or mixed in a solvent, or the like. Representative examples of the liquid include ink such as that described in the above embodiment, liquid crystal, or the like. Here, the "ink" encompasses general water-based ink and oil-based ink, as well as various types of liquid compositions such as gel ink and hot melt ink.

The invention is not limited to the above embodiments, examples, and modifications, and can be implemented in various configurations without departing from the gist of the invention. For example, the technical features in the embodiments, examples, and modifications corresponding to the technical features in the modes described in the summary of the invention may be replaced or combined as appropriate, in order to solve a part of or the entire problem described above, or to achieve some or all of the effects described above. The technical features that are not described as essential in this specification may be removed as appropriate.

What is claimed is:

1. A liquid container for supplying a liquid having a precipitating component to a liquid ejection apparatus, comprising:

a liquid containing portion that is flexible and contains the liquid, the liquid containing portion having a first end and a second end that opposes the first end;

a liquid leading portion for leading the liquid in the liquid containing portion to the liquid ejection apparatus, the liquid leading portion being attached to the first end;

a liquid flow tube that has a base end connected to the liquid leading portion, the liquid flow tube extending within the liquid containing portion from the liquid leading portion toward the second end; and a spacer member that is provided in the liquid containing portion and has a spacer body forming a liquid-retaining space for retaining the liquid in the liquid containing portion, wherein the spacer member is coupled to the liquid leading portion, and the liquid flow tube is coupled to the spacer member at a position on the second end side relative to a center of an overall length of an internal space of the liquid containing portion in a longitudinal direction of the liquid containing portion.

2. The liquid container according to claim 1, wherein the liquid flow tube has a leading end at which an introduction port for introducing the liquid to the inside thereof is formed, and a position at which the liquid flow tube is coupled to the spacer member is located on the leading end side relative to a center of the liquid flow tube in a direction parallel to the liquid flow tube.

3. The liquid container according to claim 1, wherein, in an orientation in which the liquid container is attached to the liquid ejection apparatus, the liquid flow tube is configured to extend in a horizontal direction from the liquid leading portion within the liquid containing portion, the liquid flow tube has a first flow passage and a second flow passage, the first flow passage has a first base end that is in communication with the liquid leading portion, and a first leading end that forms a first introduction port that introduces the liquid in the liquid containing portion into the first flow passage, the second flow passage has a second base end that is in communication with the liquid leading portion, and a second leading end that forms a second introduction port that introduces the liquid in the liquid containing portion into the second flow passage, and in the orientation, the first introduction port is located above the second introduction port.

4. The liquid container according to claim 3, wherein the first introduction port and the second introduction port are movable relative to the spacer body, and a distance between the first introduction port and the second introduction port gradually decreases as the liquid in the liquid containing portion is consumed and a volume of the liquid containing portion decreases.

5. The liquid container according to claim 3, wherein the first leading end and the second leading end are fixed to the spacer member.

6. The liquid container according to claim 1, wherein, in an orientation in which the liquid container is attached to the liquid ejection apparatus, the liquid flow tube is configured to extend to a side in a gravity direction from the liquid leading portion, and in the orientation, the spacer body has a portion located below the liquid flow tube.

7. The liquid container according to claim 6, wherein the liquid flow tube has a leading end that forms an introduction port for introducing the liquid in the liquid container to the inside thereof, and the leading end is fixed to the spacer member.

8. The liquid container according to claim 1, wherein a size of the spacer body is smaller than a size of the liquid leading portion in at least one of three orthogonal directions.

9. A liquid container for supplying a liquid having a precipitating component to a liquid election apparatus, comprising:

a liquid containing portion that is flexible and contains the liquid, the liquid containing portion having a first end and a second end that opposes the first end;

a liquid leading portion for leading the liquid in the liquid containing portion to the liquid ejection apparatus, the liquid leading portion being attached to the first end;

a liquid flow tube that has a base end connected to the liquid leading portion, the liquid flow tube extending within the liquid containing portion from the liquid leading portion toward the second end; and a spacer member that is provided in the liquid containing portion and has a spacer body forming a liquid-retaining space for retaining the liquid in the liquid containing portion, wherein the spacer member is coupled to the liquid leading portion, the liquid flow tube is coupled to the spacer member, in an orientation in which the liquid container is attached to the liquid ejection apparatus, the liquid flow tube is configured to extend in a horizontal direction from the liquid leading portion within the liquid containing portion, the liquid flow tube has a first flow passage and a second flow passage, the first flow passage has a first base end that is in communication with the liquid leading portion, and a first leading end that forms a first introduction port that introduces the liquid in the liquid containing portion into the first flow passage, the second flow passage has a second base end that is in communication with the liquid leading portion, and a second leading end that forms a second introduction port that introduces the liquid in the liquid containing portion into the second flow passage, in the orientation, the first introduction port is located above the second introduction port, and positions of the first leading end and the second leading end relative to the spacer member are fixed regardless of a change in the volume of the liquid containing portion.

10. A liquid container for supplying a liquid having a precipitating component to a liquid ejection apparatus, comprising:

a liquid containing portion that is flexible and contains the liquid, the liquid containing portion having a first end and a second end that opposes the first end;

a liquid leading portion for leading the liquid in the liquid containing portion to the liquid ejection apparatus, the liquid leading portion being attached to the first end;

a liquid flow tube that has a base end connected to the liquid leading portion, the liquid flow tube extending within the liquid containing portion from the liquid leading portion toward the second end; and a spacer member that is provided in the liquid containing portion and has a spacer body forming a liquid-retaining space for retaining the liquid in the liquid containing portion, wherein the spacer member is coupled to the liquid leading portion, the liquid flow tube is coupled to the spacer member, and the spacer member has a center beam that extends in a first direction parallel to a direction moving from the first end side toward the second end side of the liquid containing portion, a first edge beam and a second edge beam that extend in the first direction, the first edge beam and the second edge beam being arranged at positions on both sides of the center beam in a second direction perpendicular to the first direction, and comb teeth that connect the center beam to the first edge beam and also connect the center beam to the second edge beam, the comb teeth including a plurality of through holes passing through in a third direction perpendicular to the first direction and second direction.

11. The liquid container according to claim 10, wherein, in an orientation in which the liquid container is attached to the liquid ejection apparatus, the third direction is a direction parallel to a gravity direction.

* * * * *